US006837750B2

(12) United States Patent
Fukuda et al.

(10) Patent No.: US 6,837,750 B2
(45) Date of Patent: Jan. 4, 2005

(54) CONNECTOR AND CONNECTOR HOUSING HAVING A NOTCH FORMED IN AN EDGE OF THE CONNECTOR HOUSING TO FACILITATE CONNECTION

(75) Inventors: Eiji Fukuda, Shizuoka (JP); Masanori Wakui, Toyota (JP)

(73) Assignee: Yazaki Corporation, Tokyo (JP)

( * ) Notice: Subject to any disclaimer, the term of this patent is extended or adjusted under 35 U.S.C. 154(b) by 52 days.

(21) Appl. No.: 10/217,472

(22) Filed: Aug. 14, 2002

(65) Prior Publication Data

US 2003/0036308 A1 Feb. 20, 2003

(30) Foreign Application Priority Data

Aug. 17, 2001 (JP) ..... 2001-248223

(51) Int. Cl.[7] ..... H01R 13/64
(52) U.S. Cl. ..... 439/680; 439/954
(58) Field of Search ..... 439/680, 357, 439/954

(56) References Cited

U.S. PATENT DOCUMENTS

| | | | | | |
|---|---|---|---|---|---|
| 3,399,374 | A | * | 8/1968 | Pauza et al. | 439/355 |
| 4,229,064 | A | * | 10/1980 | Vetter et al. | 439/680 |
| 4,245,875 | A | * | 1/1981 | Shaffer et al. | 439/144 |
| 4,666,325 | A | | 5/1987 | Vantouroux | 403/13 |
| 4,764,129 | A | * | 8/1988 | Jones et al. | 439/677 |
| 5,573,412 | A | | 11/1996 | Anthony | 439/133 |
| 5,954,520 | A | * | 9/1999 | Schmidt | 439/39 |
| 6,402,565 | B1 | * | 6/2002 | Pooley et al. | 439/680 |
| 2003/0036302 | A1 | * | 2/2003 | Fukuda | 439/374 |

FOREIGN PATENT DOCUMENTS

| | | |
|---|---|---|
| DE | 25 34 775 | 2/1977 |
| DE | 195 25 413 A1 | 1/1996 |
| DE | 197 21 405 A1 | 12/1997 |
| EP | 1 124 290 | 8/2001 |
| EP | 1 139 497 | 10/2001 |
| EP | 1 187 266 | 3/2002 |
| JP | 60-180076 | 9/1985 |
| JP | 4-303577 | 10/1992 |
| JP | 11-54210 | 2/1999 |
| JP | 11-307182 | 11/1999 |

OTHER PUBLICATIONS

German Office Action dated Feb. 2, 2004 (w/translation).
Copy of European Patent Office Communication including European Search Report for corresponding European Patent Application GB 0218833.2 dated Dec. 5, 2002.

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

A connector is provided, by which an undesirable connection between housings of an improper product number can be prevented, and a connector housing is provided, by which an undesirable connection to a connector housing of an improper product number can be prevented. The connector having a lock security mechanism includes a female housing having a body part for receiving a male terminal and male housing having a body part receiving a female terminal and a bushing. The bushing is formed with a plurality of peripheral walls, one of which is provided with a notch. The body part of the male housing is inserted into the female housing and the female housing is inserted into the bushing, thereby the two housings are coupled with each other.

1 Claim, 17 Drawing Sheets

10
11
2a 10
11
2a

CONNECTOR AND CONNECTOR HOUSING HAVING A NOTCH FORMED IN AN EDGE OF THE CONNECTOR HOUSING TO FACILITATE CONNECTION

BACKGROUND OF THE INVENTION (1) Field of the Invention

The present invention relates to a connector and connector housing used for connecting electric wires and so on.

(2) Description of the Related Art

A wiring harness for use in a motor vehicle as a mobile unit includes a connector, in which a male connector housing (hereinafter, male housing) and a female connector housing (hereinafter, female housing) are connected to each other. The male and female housings receive terminal fittings with an electric wire.

There are a plurality of product numbers for the male housing. The male housing of one product number has about the same shape as that of the male housing of the other product number. There are a plurality of product numbers for the female housing. The female housing of one product number has about the same shape as that of the female housing of the other product number.

The connector is constituted by connecting one of the male housings of various product numbers and one of the female housings of various product numbers. There are some specific combinations between the male and female housings, which can be adoptable. On the other hand, there are combinations between the male and female housings, which can not be adoptable. This is a reason why various measures have been employed so far in order to prevent an error in the combination from occurring and to properly connect the male and female housings of desired product number to each other.

The female housing is formed in a cylindrical shape receiving a male-type terminal fittings (hereinafter, male terminal) therein. The male housing has a cylindrical bushing and a body disposed in the bushing. A peripheral wall of the bushing is gradually formed thin as approaching an opening thereof. The body receives, for example, a female-type terminal fittings (hereinafter, female, terminal). The body of the male housing enters into the female housing and the female housing enters into the bushing of the male housing, thereby the male and female housings are connected to each other.

Consequently, as a measure for preventing an error in the combination, a projection projecting from a surface of the female housing has been employed. The male housing of the desired product number to be connected to the female housing, which has the projection, is provided with a recess, into which the projection enters. When the projection enters into the recess, the female housing is connected to the male housing of the desired product number.

The male housing of the other product number, which is not to be connected to the female housing having the projection, is not provided with the recess. The projection comes in contact with the periphery of the opening and the female housing can not be connected to the male housing of the other product number. Thus, the male and female housings of the desired product number have been connected to each other.

The peripheral wall of the bushing of the male housing is gradually formed thin as approaching an opening thereof. Therefore, in the connector having the projection for preventing an error in the combination, when the female housing having the projection is inserted into the male housing of the other product number from an oblique direction, the male housing might possibly be resiliently deformed in a direction, in which the opening of the bushing extends, by the principle of a lever and so on.

That is, when the female housing having the projection is inserted into the male housing of the other product number from an oblique direction, the female housing might possibly easily enter into the bushing of the improper male housing. Thus, in the connector having the projection as the conventional measure for preventing an error in the combination from occurring, there has been a possibility that the connector housings of improper product number are connected to each other.

SUMMARY OF THE INVENTION

It is therefore a first objective of the present invention to provide a connector, by which an undesirable connection between the housings of the improper product number can be securely prevented from occurring. It is a second objective of the present invention to provide a connector housing, by which an undesirable connection to the connector housing of the improper product number can be securely prevented from occurring.

In order to attain the first objective, the present invention is to provide a connector constructed by coupling a connector housing having a tube-shaped casing with a first mating connector housing having a first housing body insertable into the casing, the connector housing comprising:

obstruction means for preventing a second mating connector housing, which includes a second housing body of the same shape as that of the first housing body and a projection outwardly protruding from the second housing body, from entering into the casing, wherein the obstruction means is a notch formed by notching an edge of the casing near to the second mating connector housing and the notch faces the projection when the second mating connector housing enters into the casing.

In the connector described above, the obstruction means for preventing the second mating connector housing from entering into the casing of the connector housing is the notch formed by notching the edge of the casing. When the second mating connector housing is about to be inserted into the casing of the connector housing, the projection comes in contact with the surface of the notch.

The casing is formed thick at the position where the projection comes in contact. Therefore, the casing is hard to be resiliently deformed there, even if the second mating connector housing is about to be inserted into the casing from the inclined direction. That is, even when the second mating connector housing is about to be inserted into the casing from the inclined direction, the projection comes in contact with the notch, thereby the second mating connector can not enter into the casing.

Therefore, the second mating connector housing can not be entered into the connector housing, thereby the miscoupling between the connector housing and the second mating connector housing can be securely prevented from occurring. That is, the miscoupling of the connector housings having the improper product number can be securely prevented from occurring.

Preferably, a face of the notch facing the second mating connector housing is gradually inclined toward the outside of the casing as the face leaving the second mating connector housing and also is inclined relatively to the insertion direction of the second mating connector housing into the casing.

In the connector described above, a face of the notch facing the second mating connector housing is gradually inclined toward the outside of the casing as the face leaving the second mating connector housing. Therefore, since the projection of the second mating connector housing comes in contact with the face of the notch, the projection tends to be displaced toward the outside of the casing even if the second mating connector housing is pushed toward the casing.

Therefore, the second mating connector housing can not be entered into the connector housing, thereby the miscoupling between the connector housing and the second mating connector housing can be securely prevented from occurring. That is, the miscoupling of the connector housings having the improper product number can be securely prevented from occurring.

In order to attain the second objective, the present invention is to provide a connector housing to be coupled with a first mating connector housing, comprising:

a tube-shaped casing, into which a first housing body of the first mating connector housing can enter; and obstruction means for preventing a second mating connector housing, which includes a second housing body of the same shape as that of the first housing body and a projection outwardly protruding from the second housing body, from entering into the casing, wherein the obstruction means is a notch formed by notching an edge of the casing near to the second mating connector housing and the notch faces the projection when the second mating connector housing enters into the casing.

In the connector housing described above, the obstruction means for preventing the second mating connector housing from entering into casing is the notch formed by notching the edge of the casing. When the second mating connector housing is about to be inserted into the casing, the projection comes in contact with the surface of the notch.

The casing is formed thick at the position where the projection comes in contact. Therefore, the casing is hard to be resiliently deformed there, even if the second mating connector housing is about to be inserted into the casing from the inclined direction. That is, even when the second mating connector housing is about to be inserted into the casing from the inclined direction, the projection comes in contact with the notch, thereby the second mating connector can not enter into the casing.

Therefore, the second mating connector housing can not be inserted into the casing, thereby the connector housing is securely prevented from being coupled with the second mating connector housing. That is, the miscoupling of the connector housings having the improper product number can be securely prevented from occurring.

Preferably, a face of the notch facing the second mating connector housing is gradually inclined toward the outside of the casing as the face leaving the second mating connector housing and also is inclined relatively to the insertion direction of the second mating connector housing into the casing.

In the connector housing described above, a face of the notch facing the second mating connector housing is gradually inclined toward the outside of the casing as the face leaving the second mating connector housing. Therefore, since the projection of the second mating connector housing comes in contact with the face of the notch, the projection tends to be displaced toward the outside of the casing even if the second mating connector housing is pushed toward the casing.

Therefore, the second mating connector housing can not be inserted into the casing, thereby the connector housing is securely prevented from being coupled with the second mating connector housing. That is, the miscoupling of the connector housings having the improper product number can be securely prevented from occurring.

In order to attain the first objective, the present invention is to provide a connector constructed by coupling a second connector housing with a third mating connector housing, the second connector housing comprising:

a third housing body insertable into the third mating connector housing; and a second projection outwardly protruding from the third housing body, the third mating connector housing comprising:

a second casing, into which the third housing body can enter; and a recess, into which the second projection can enter, the second connector housing further comprising:

second obstruction means for preventing the third housing body from entering into a fourth mating connector housing, which includes a third casing of the same shape as that of the second casing, wherein the second obstruction means is a second notch formed by notching an edge of the second projection near to the fourth mating connector housing.

In the connector described above, the second notch for preventing the third housing body of the second connector housing from entering into the fourth mating connector housing is formed by notching the edge of the second projection near to the fourth mating connector housing. When the second connector housing is about to be inserted into the third casing from the inclined direction, the second projection comes in contact with the edge of the third casing.

Therefore, the second projection does not enter into the third casing, even if the second connector housing is about to be inserted into the third casing, from the inclined direction.

Therefore, the second connector housing can not be inserted into the third casing of the fourth mating connector housing, thereby the second connector housing is securely prevented from being coupled with the fourth mating connector housing. That is, the miscoupling of the connector housings having the improper product number can be securely prevented from occurring.

Preferably, a face of the second notch facing the fourth mating connector housing is gradually inclined in the direction of approaching the third housing body as the face leaving the fourth mating connector housing and also is inclined relatively to the insertion direction of the second connector housing into the third casing.

In the connector described above, the face of the second notch facing the fourth mating connector housing is gradually inclined in the direction of approaching the third housing body as the face leaving the fourth mating connector housing. Therefore, since the fourth mating connector housing comes in contact with the face of the second notch, the second projection tends to be displaced toward the outside of the third casing even if the third housing body is pushed toward the fourth mating connector housing.

Therefore, the second connector housing can not be inserted into the third casing of the fourth mating connector housing, thereby the second connector housing is securely prevented from being coupled with the fourth mating connector housing. That is, the miscoupling of the connector housings having the improper product number can be securely prevented from occurring.

In order to attain the second objective, the present invention is to provide a connector housing to be coupled with a third mating connector housing having a tube-shaped second casing, comprising:

a third housing body insertable into the second casing;

a second projection outwardly protruding from the third housing body; and second obstruction means for preventing the third housing body from entering into a fourth mating connector housing, which includes a third casing of the same shape as that of the second casing, wherein the second obstruction means is a second notch formed by notching an edge of the second projection near to the fourth mating connector housing.

In the connector housing described above, the second notch is formed by notching the edge of the second projection near to the fourth mating connector housing. When the connector housing is about to be inserted into the third casing, the second projection comes in contact with the edge of the third casing.

Therefore, even if the connector housing is about to be inserted into the third casing, the second projection does not enter into the third casing.

Therefore, the connector housing can not be inserted into the third casing of the fourth mating connector housing, thereby the connector housing is securely prevented from being coupled with the fourth mating connector housing. That is, the miscoupling of the connector housing with a mating connector housing having the improper product number can be securely prevented from occurring.

Preferably, a face of the second notch facing the fourth mating connector housing is gradually inclined in the direction of approaching the third housing body as the face leaving the fourth mating connector housing and also is inclined relatively to the insertion direction of the connector housing into the third casing.

In the connector housing described above, the face of the second notch facing the fourth mating connector housing is gradually inclined in the direction of approaching the third housing body as the face leaving the fourth mating connector housing. Therefore, since the fourth mating connector housing comes in contact with the face of the second notch, the second projection tends to be displaced toward the outside of the third casing even if the third housing body is pushed toward the fourth mating connector housing.

Therefore, the connector housing can not be inserted into the third casing of the fourth mating connector housing, thereby the connector housing is securely prevented from being coupled with the fourth mating connector housing. That is, the miscoupling of the connector housing with a mating connector housing having the improper product number can be securely prevented from occurring.

DESCRIPTION OF THE PREFERRED EMBODIMENTS

Figure 1:
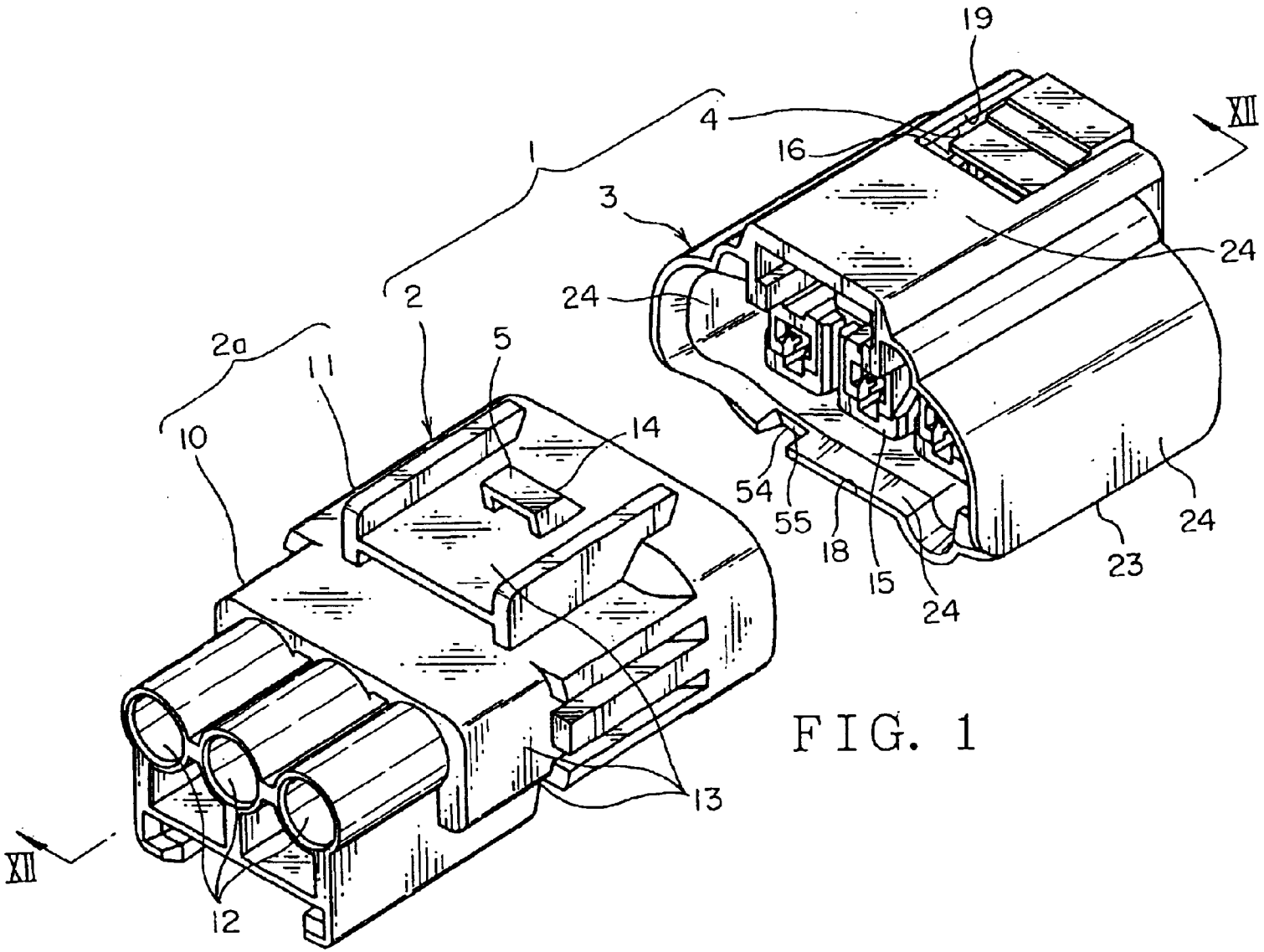
FIG. 1 is an exploded perspective view illustrating a connector having a lock security mechanism according to a first preferred embodiment of the present invention.
Figure 2:
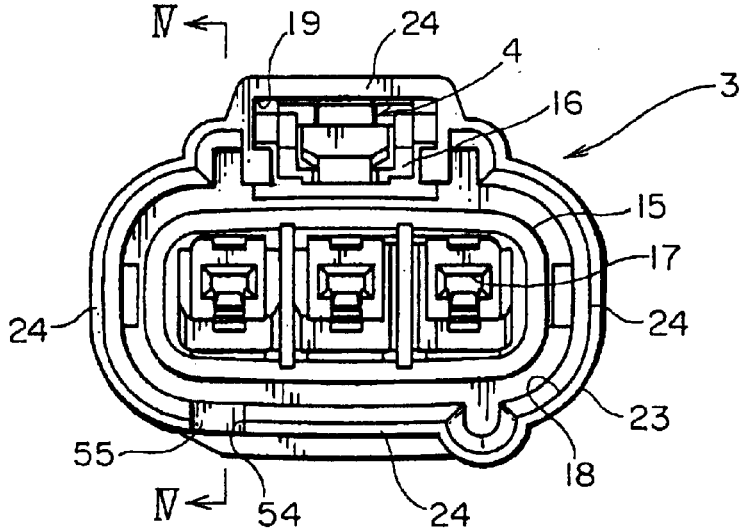
FIG. 2 is a front view of a male housing of the connector having a lock security mechanism shown in FIG. 1.
Figure 3:
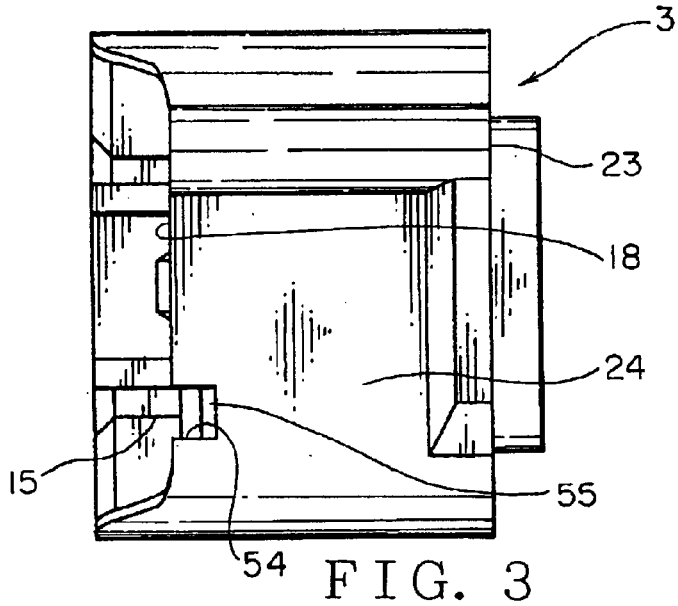
FIG. 3 is a bottom view of the male housing shown in FIG. 2.
Figure 11:
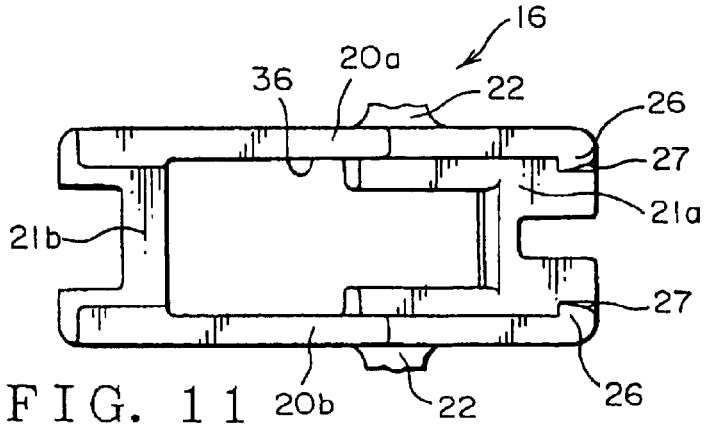
FIG. 11 is a bottom view illustrating a locking arm of the connector having a lock security mechanism shown in FIG. 1.
Figure 12:
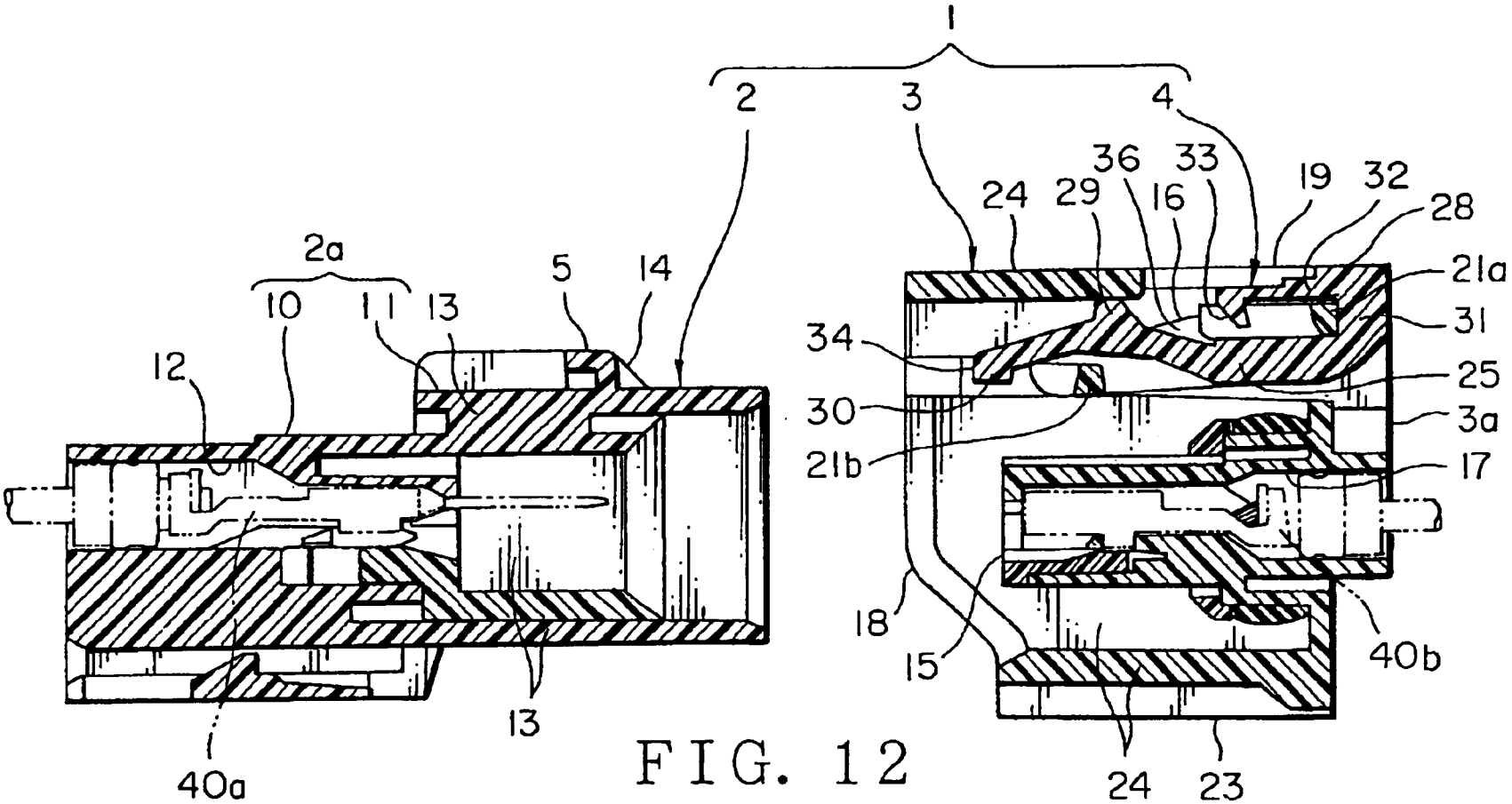
FIG. 12 is a cross sectional view taken along XII—XII line in FIG. 1.
Figure 16:
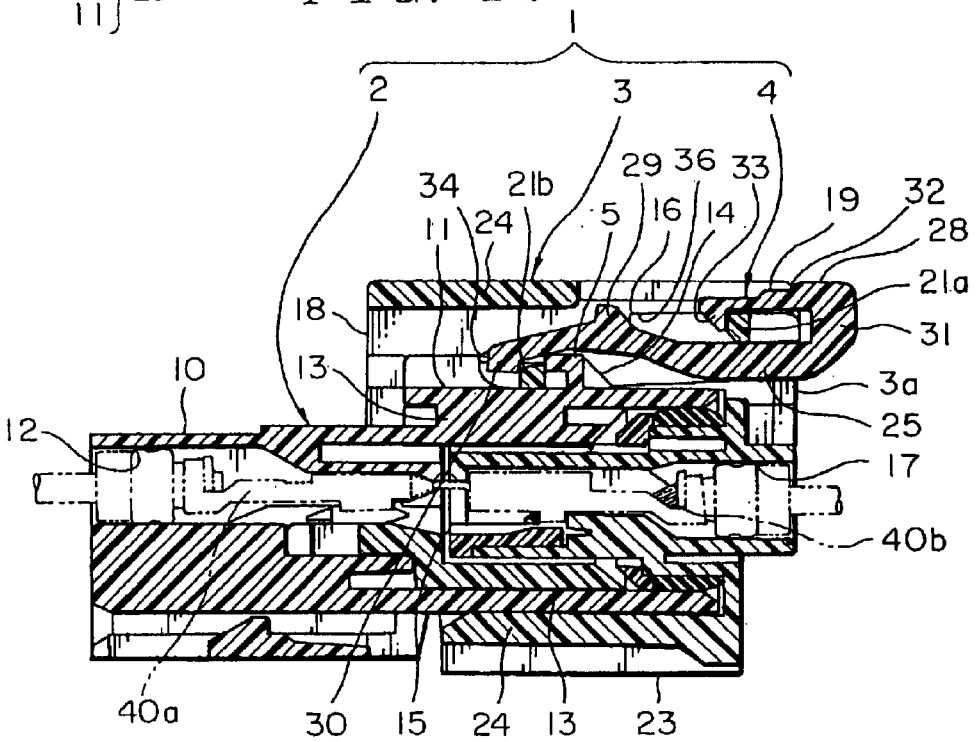
FIG. 16 is a cross sectional view illustrating a state, in which a locking projection engages with a locking hole of the locking arm starting from the state shown in FIG. 15.
Figure 17:
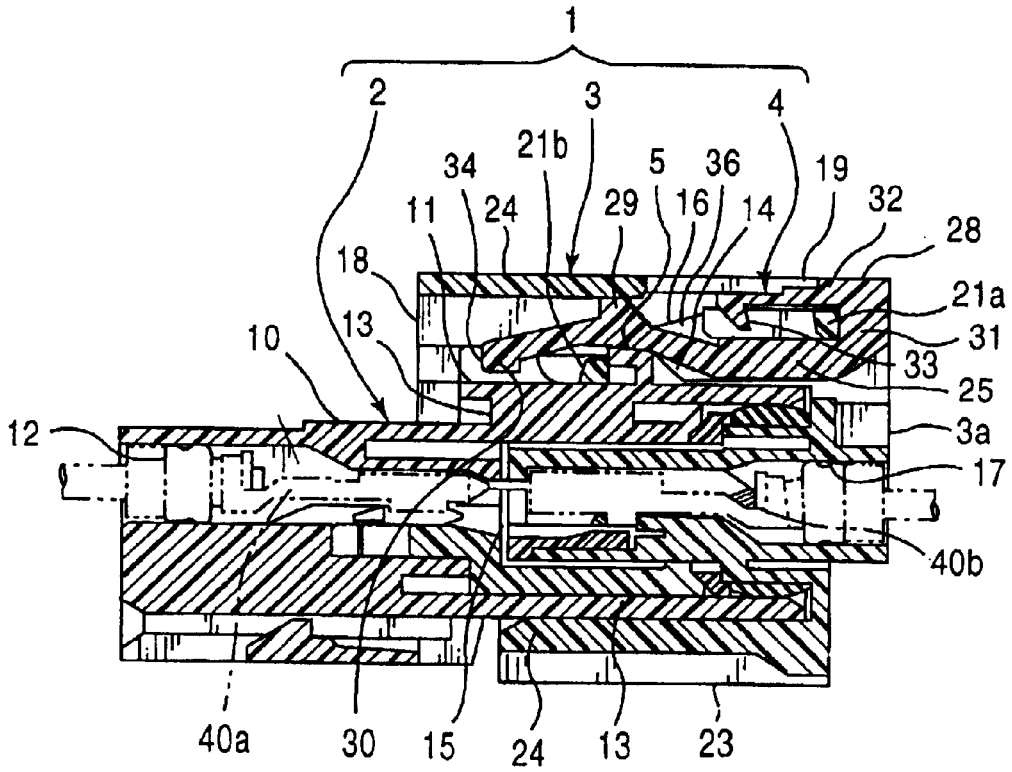
FIG. 17 is a cross sectional view illustrating a state, in which the lock security member is displaced from the state shown in FIG. 16 to a regulated position.

A connector having a lock security mechanism as a connector according to a first preferred embodiment of the present invention will be explained with reference to FIGS. 1–26. The connector 1 having a lock security mechanism shown in FIG. 1 and other figures constitutes a wiring harness arranged in a motor vehicle and so on. As shown in FIGS. 1, 12 and 17, the connector 1 having a lock security mechanism includes a female-type connector housing (hereinafter, female housing) 2, a male-type connector housing (hereinafter, male housing) 3, and a lock security member 4.

The female housing 2 is made of synthetic resin. As shown in FIGS. 1, 5, 8, 12 and 17, the female housing 2 includes a housing body 2*a*. The housing body 2*a* includes a body part 10 and tube-shaped bushing 11. In this specification, a connector housing formed in a tube-shape, into which a body part 15 of the male housing 3 is inserted, is called a female-type connector housing.

As shown in FIG. 12, the body part 10 of the housing body 2*a* receives a plurality of male-type terminal fittings (hereinafter, male terminal) 40*a*. The body part 10 includes a plurality of terminal-receiving chambers 12 arranged in parallel to each other. Each terminal-receiving chamber 12 extends straightly and receives the male terminal 40*a*.

The bushing 11 receives the body part 15 (explained later on) of the male housing 3 therein. The bushing 11 is formed in a box-shape (tube-shape) including a plurality of peripheral walls 13 each of which continues to the outer edge of the body part 10. That is, the bushing 11 continues to the body part 10. An edge of the peripheral wall 13, which stays away from the body part 10, forms an opening for receiving the body part 15 of the male housing 3.

A locking projection 5 as a locking member is formed on a peripheral wall 13 situated at upper side of the bushing 11. The locking projection 5 protrudes from an outer surface of the peripheral wall 13. The locking projection is formed at the center of the peripheral wall 13 in the width direction thereof and in the direction, in which the body part 10 and bushing 11 continue to each other.

The locking projection 5 is provided with a tapered surface 14 at the end thereof near to the opening. The tapered surface 14 is inclined relatively to both of the direction of the outer surface of the peripheral wall 13 and the direction crossing at right angles, and also is gradually inclined in the direction of leaving the opening as leaving the peripheral wall 13. The locking projection 5 engages with a locking hole 36 of a locking arm 16 (explained later on).

The male housing 3 is made of synthetic resin. As shown in FIGS. 1, 4, 12 and 17, the male housing 3 includes a body part 15, bushing 23 and locking arm 16. In this specification, a connector housing, which has the body part 15 to be inserted into the tube-shaped female housing 2 and so on, is called a male-type connector housing.

As shown in FIG. 12, the body part 15 receives a plurality of female-type terminal fittings (hereinafter, female terminal) 40*b*. The body part 15 includes a plurality of terminal-receiving chambers 17 arranged in parallel to each other. Each terminal-receiving chamber 17 extends straightly and receives the female terminal 40*b*. The body part 15 is inserted into the bushing 11 so that the terminal-receiving chamber 17 continues to the terminal-receiving chamber 12 of the female housing 2.

The bushing 23 is formed in a box-shape (tube-shape) having a plurality of peripheral walls 24. The bushing 23 accommodates the body part 15 therein. A plurality of the peripheral walls 24, which constitute the bushing 23, continue to the outer edge of the body part 15 at one end thereof. The bushing 23 receives the female housing 2. The opposite end of the peripheral wall 24 forms an opening 18 for receiving the female housing 2. The peripheral wall 24 is gradually formed thin as approaching the opening 18. A hole 19 is formed in a peripheral wall 24 situated at the upper side. The hole 19 penetrates through the peripheral wall 24.

A notch 54 as obstruction means is formed on the other peripheral wall 24 situated at the lower in the figure. The notch 54 is provided at a position where a rib 53 (explained later on) of a second female housing 52 (explained later on) is situated when the second female housing 52 is about to enter into the bushing 23 of the male housing 3. The notch 54 is formed hollow from the edge of the peripheral wall 24, which constitutes the opening 18. That is, the notch 54 is formed by notching the edge of the bushing 23 near to the second female housing 52.

Figure 4:
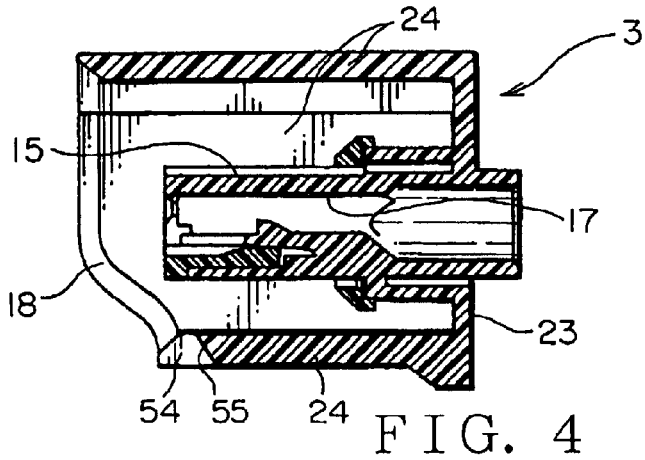
FIG. 4 is a cross sectional view taken along IV—IV line in FIG. 2.
Figure 5:
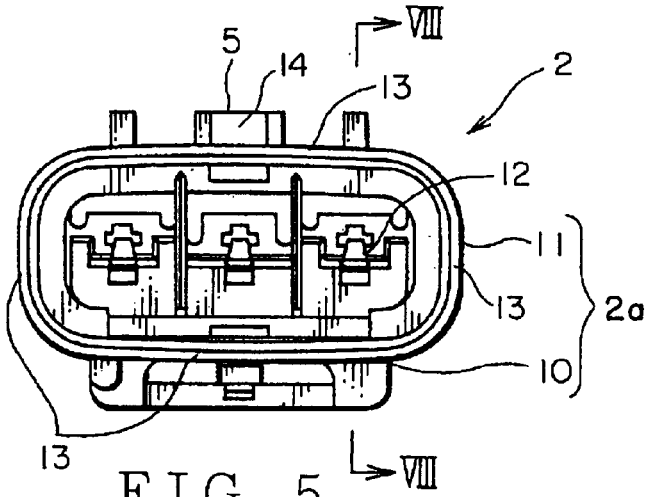
FIG. 5 is a front view of a female housing of the connector having a lock security mechanism shown in FIG. 1.
Figure 6:
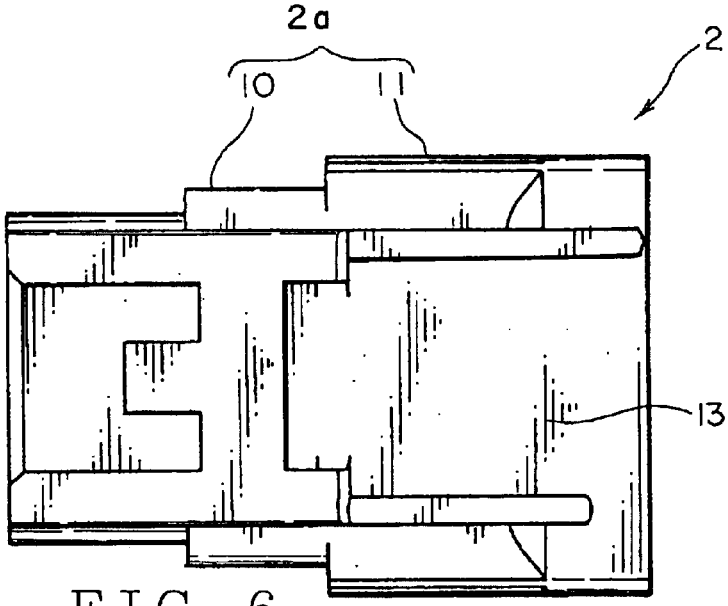
FIG. 6 is a bottom view of the female housing shown in FIG. 5.
Figure 7:
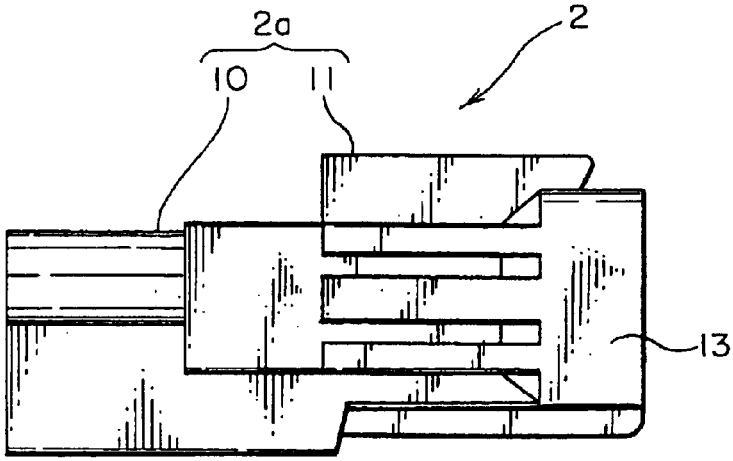
FIG. 7 is a side view of the female housing shown in FIG. 5.
Figure 8:
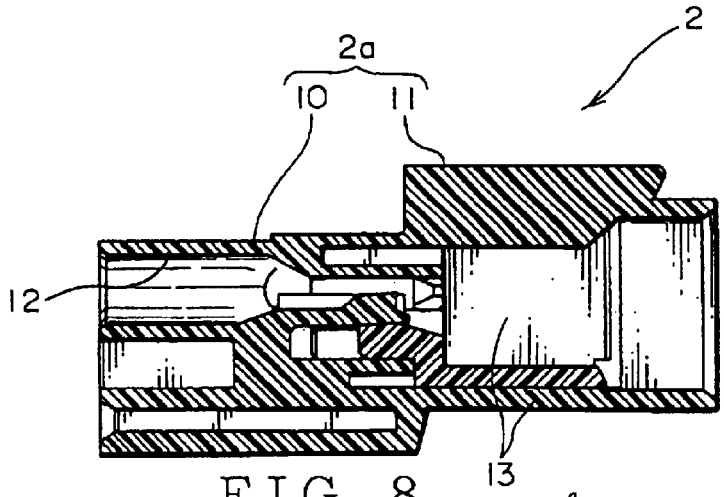
FIG. 8 is a cross sectional view taken along VIII—VIII line in FIG. 5.

As shown in FIG. 4, a face 55 of the notch 54, which faces the projection (rib) 53, that is, which faces the female housing 2, 52, is gradually inclined toward the outside of the male housing 3 as leaving the opening 18, that is, as leaving the female housing 2, 52. The face 55 is also inclined relatively to the direction, in which the female housing 2 and male housing 3 approach each other when the female housing 2 is coupled with the male housing 3. That is, the face 55 is inclined relatively to the insertion direction of the second female housing 52 into the bushing 23.

The locking arm 16 is made of synthetic resin and can be deformed resiliently. As shown in FIG. 11, the locking arm 16 is formed in a frame-shape including a pair of first bars 20*a*, 20*b* and a pair of second bars 21*a*, 21*b*. The pair of first bars 20*a*, 20*b* is arranged in parallel to each other having a distance therebetween. Each second bar 21*a*, 21*b* is shorter than each first bar 20*a*, 20*b*. The pair of second bars 21*a*, 21*b* is arranged in parallel to each other having a distance therebetween. Each second bar 21*a*, 21*b* connects the corresponding ends of the first bar 20*a*, 20*b*.

The locking arm 16 is arranged inside the bushing 23. The locking arm 16 is disposed between the peripheral wall on which the hole 19 is provided and the body part 15. The length direction of the locking arm 16 is parallel to the length direction of the terminal-receiving chamber 17, that is, the length direction of the female terminal 40*b*. The length direction of the locking arm 16 is parallel to the direction of the housings 2 and 3 approaching each other when they are coupled to each other. At the center in the length direction of the locking arm 16, a pair of support pieces 22 (shown in FIG. 11) is attached.

The support piece 22 continues to both edges of the locking arm 16 in the width direction. The support piece 22 continues to both of the edge of the locking arm 16 in the width direction and the inner surface of the bushing 23. The support piece 22 is integrally formed with both of the locking arm 16 and the bushing 23. The support piece 22 can be resiliently deformed. The locking arm 16 is supported movable relatively to the bushing 23 having the center of the length direction as a center. That is, when the support piece 22 is resiliently deformed, the center of the locking arm 16 in the length direction is hardly displaced relatively to the bushing 23 while both ends of the locking arm 16 in the length direction is displaced relatively to the bushing 23.

As shown in FIG. 11, a claw 26 is provided at each end of the pair of the first bare 20*a*, 20*b*, each said end being situated farther from the opening 18. Each claw 26 protrudes from the end in the direction of approaching each other. An inclined surface 27 is provided at the end of the claw 26, said end being situated farther from the opening 18. The inclined surface 27 is inclined in the inward direction of the locking arm 16 as approaching the opening 18, that is, as approaching the female housing 2, and is inclined relatively to both of the length and width directions of the locking arm 16.

The inside of the locking arm 16 forms a locking hole 36. The locking projection 5 enters inside the locking hole 36, thereby the locking projection 5 engages with the locking hole 36. That is, the locking projection 5 can engage with the locking arm 16.

Figure 9:
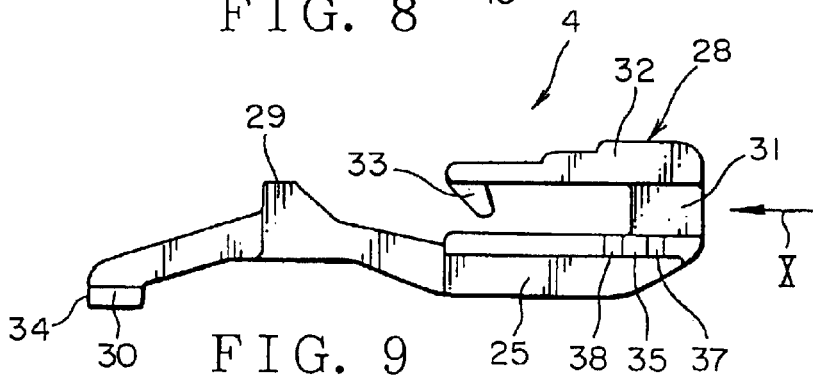
FIG. 9 is a side view illustrating a lock security member of the connector having a lock security mechanism shown in FIG. 1.
Figure 10:
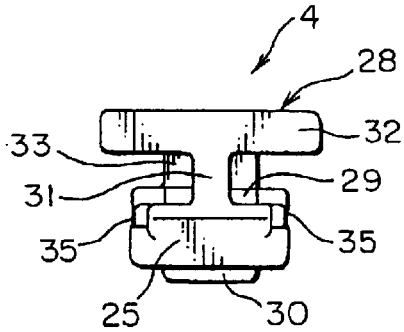
FIG. 10 is a front view illustrating the lock security member viewed from the direction of arrow X in FIG. 9.

The lock security member 4 is made of synthetic resin and can be deformed resiliently. As shown in FIGS. 9 and 10, the lock security member 4 includes a member body 25 formed in an arm-shape, mount 28, abutting part 30, and projection 29.

The member body 25 is entered inside the locking hole 36 in a manner that the length direction of the member body 25 is parallel to the direction, in which the housings 2 and 3 approach each other. As shown in FIG. 12, one end of the member body 25 situated farther from the opening 18 is arranged between the body part 15 and the second bar 21*a*, which is situated farther from the opening 18 than the second bar 21*b*.

The opposite end of the member body 25 near to the opening 18 is arranged between the peripheral wall 24 and the second bar 21*b*, which is situated nearer to the opening 18 than the second bar 21*a*. That is, the member body 25 of the lock security member 4 is entered into the locking hole 36 of the locking arm 16 in a state that one end is situated between the locking arm 16 and the body part 15 while the opposite end is situated between the locking arm 16 and the peripheral wall 24.

The mount 28 continues to the one end of the member body 25. The mount 28 includes a first extending part 31, second extending part 32 and locking claw 33. The first extending part 31 extends as long as the thickness of the second bar 21*a* from the one end of the member body 25 toward the outside of the male housing 3. The second extending part 32 extends from the end of the first extending part 31 situated farther from the member body 25 toward the opening 18 in parallel with the member body 25. The second extending part 32 is longer than the width of the second bar 21*a*. The locking claw 33 extends from the end of the second extending part 32 near to the opening 18 toward the member body 25.

The mount 28 is mounted to the locking arm 16 in a state that the locking claw 33 enters into the inside of the locking hole 36 and the second bar 21*a* is received among the first extending part 31, second extending part 32 and the locking claw 33. Therefore, the mount 28, that is, the lock security member 4 is supported by the locking arm 16 moving slidably in the range between a position (hereinafter, regulated position; shown in FIG. 12) where the first extending part 31 comes in contact with the second bar 21*a* and another position (hereinafter, allowed position; shown in FIG. 14) where the locking claw 33 comes in contact with the second bar 21*a*. When the mount 28 is mounted to the locking arm 16, the second extending part 32 is exposed outside through the hole 19.

At the regulated position, the locking claw 33 is situated having a distance relatively to the second bar 21*a*. At the allowed position, the first extending part 31 is situated having a distance relatively to the second bar 21*a*. At the regulated position, the mount 28 is situated on the same plane as the outer surface 3*a* (shown in FIG. 12) of the male housing 3, which is situated farthest from the female housing 2, or a little sinks from the outer surface 3*a*. At the allowed position, the mount 28 protrudes from the outer surface 3*a* (shown in FIG. 14) of the male housing 3, which is situated farthest from the female housing 2.

The abutting part 30 is provided at the opposite end of the member body 25 near to the opening 18. The abutting part 30 extends from the opposite end toward the body part 15. At the regulated position, the abutting part 30 has a distance from the second bar 21*b*. At the allowed position, the abutting part 30 comes in contact with the second bar 21*b*. By the mount 28 and abutting part 30, the lock security member 4 slidably supported by the locking arm 16 does not come off from the locking arm 16. That is, the lock security member 4 is prevented from approaching the female housing 2 from the regulated position and also prevented from leaving the female housing 2 from the allowed position.

A surface (hereinafter, contact surface) 34 of the abutting part 30 near to the opening is flat. The contact surface 34 crosses at right angles to the direction, in which the housings 2 and 3 approach each other. The contact surface 34 comes in contact with the locking projection 5 of the female housing 2 in the range between the regulated and allowed positions when the housings 2 and 3 are coupled with each other.

The projection 29 is formed at the center of the length direction of the member body 25. The projection 29 extends toward the one peripheral wall 24 from the member body 25. At the regulated position, the projection 29 comes in contact with the inner surface of the one peripheral wall 24 or faces the inner surface. At the allowed position, the projection 29 is exposed outside through the hole 19.

The width of the one end of the member body 25 is about the same as the distance between the two claws 26. A pair of convexes 35 is formed at the one end of the member body 25. As shown in FIG. 10, each convex 35 protrudes from the corresponding edge of the width direction of the member body 25 toward the outside of the member body 25 in the width direction. As shown by alternate long and two short dashed line in FIGS. 18 and 19, the convex 35 includes a first inclined surface 37 and second inclined surface 38.

Figure 19:
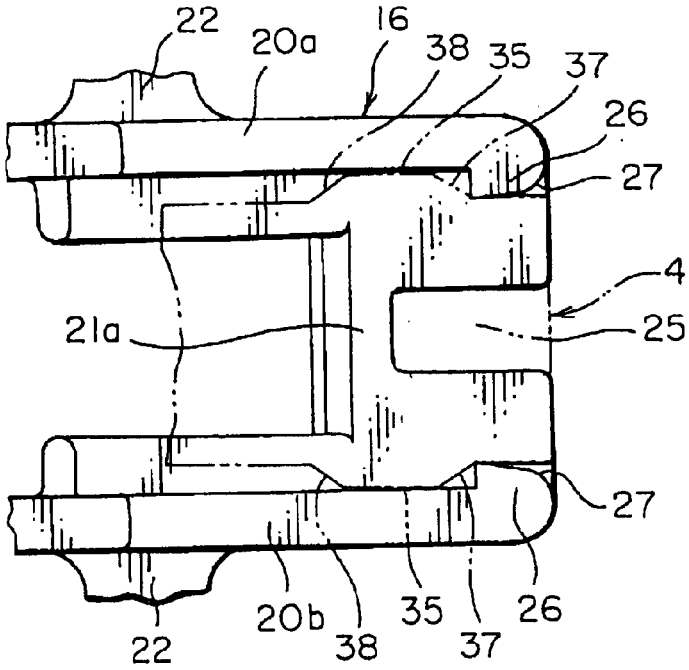
FIG. 19 is a view schematically illustrating a positional relation between a claw at the regulated position and a convex of the connector having a lock security mechanism shown in FIG. 1.

The first inclined surface 37 is formed at an end of the convex 35 apart from the opening 18, that is, near to the outside of the male housing 3. The first inclined surface 37 is inclined in the direction of approaching the member body 25 as leaving the opening 18, that is, as going to the outside of the male housing 3, and also inclined relatively to both of the length and width directions of the member body 25. As shown in FIG. 19, the first inclined surface 37 faces the claw 26 at the regulated position.

Figure 18:
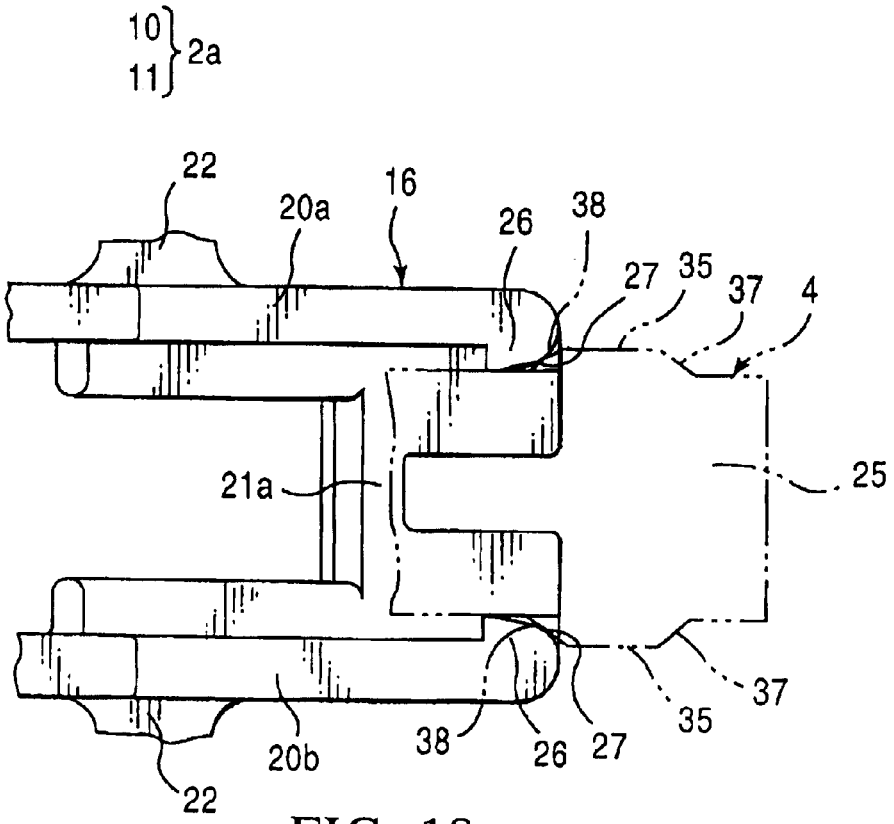
FIG. 18 is a view schematically illustrating a positional relation between a claw at the allowed position and a convex of the connector having a lock security mechanism shown in FIG. 1.

The second inclined surface 38 is formed at an end of the convex 35 near to the opening 18, that is, near to the inside of the male housing 3. The second inclined surface 38 is inclined in the direction of approaching the member body 25 as approaching the opening 18, that is, as going to the inside of the male housing 3, and also inclined relatively to both of the length and width directions of the member body 25. As shown in FIG. 18, the second inclined surface 38 faces the inclined surface 27 of the claw 26 at the allowed position. The pair of claws 26 and the pair of convexes 35 constitute means for maintaining position.

As shown in FIG. 19, at the regulated position, the first inclined surface 37 faces the claw 26 and the convex 35 is situated between the first bars 20*a* and 20*b*, that is, situated inside the locking arm 16. When the lock security member 4 is displaced toward the outside of the male housing 3, the first inclined surface 37 comes in contact with the claw 26. Then, the locking arm 16 is resiliently deformed in the direction, in which the distance between the first bars 20*a* and 20*b* increases. Then, the resilient restoring force arises. Then, the claw 26 climbs over the convex 35 and as shown in FIG. 18 the second inclined surface 38 is displaced to the allowed position where the second inclined surface 38 faces the inclined surface 27 of the claw 26.

When the lock security member 4 is displaced from the allowed position to the regulated position, the locking arm 16 once resiliently be deformed in the direction, in which the distance between the first bars 20*a* and 20*b* increases. Then, the resilient restoring force arises. When the lock security member 4 is displaced to the regulated position, the resilient restoring force disappears. Thus, when the lock security member 4 is displaced from the regulated position to the allowed position or displaced from the allowed position to the regulated position, the locking arm 16 is resiliently deformed and the resilient restoring force arises. Therefore, when the lock security member 4 is displaced from the regulated position to the allowed position or displaced from the allowed position to the regulated position, the resistance arises accompanied with the resilient restoring force.

Consequently, the claw 26 and convex 35 gives the control to the lock security member 4, which is displaced from the regulated position to the allowed position or displaced from the allowed position to the regulated position. Further, the claw 26 and convex 35 holds the lock security member 4 situated at the regulated position at the regulated position, and holds the lock security member 4 situated at the allowed position at the allowed position. Furthermore, the claw 26 and convex 35 lock each other by the inclined surfaces 37, 38 and so on in the range between the regulated and allowed positions.

At the regulated position, the projection 29 comes in contact with or faces the inner surface of the one peripheral wall 24. Thereby, the opposite end of the member body 25 near to the opening 18 is prevented from being displaced toward the outside of the male housing 3. That is, the locking arm 16 is prevented from being resiliently deformed. Thus, at the regulated position, the lock security member 4 regulates the resilient deformation of the locking arm 16.

At the allowed position, the projection 29 is exposed outside of the male housing 3 through the hole 19. Therefore, the end of the member body 25 near to the opening 18 is allowed to be displaced toward the outside of the male housing 3. That is, the locking arm 16 is allowed to be resiliently deformed. Thus, at the allowed position, the lock security member 4 allows the locking arm 16 to be resiliently deformed.

When the connector 1 having the lock security mechanism described above is assembled, the lock security member 4 is preferably to be situated at the regulated position as shown in FIG. 12 before the coupling of the female housing 2 and male housing 3. When the female housing 2 and male housing 3 are coupled to each other, as shown in FIGS. 1 and 12, first the opening of the bushing 11 is made face the opening of the bushing 23. At this time, the opening of the bushing 11 faces the body part 15.

Figure 13:
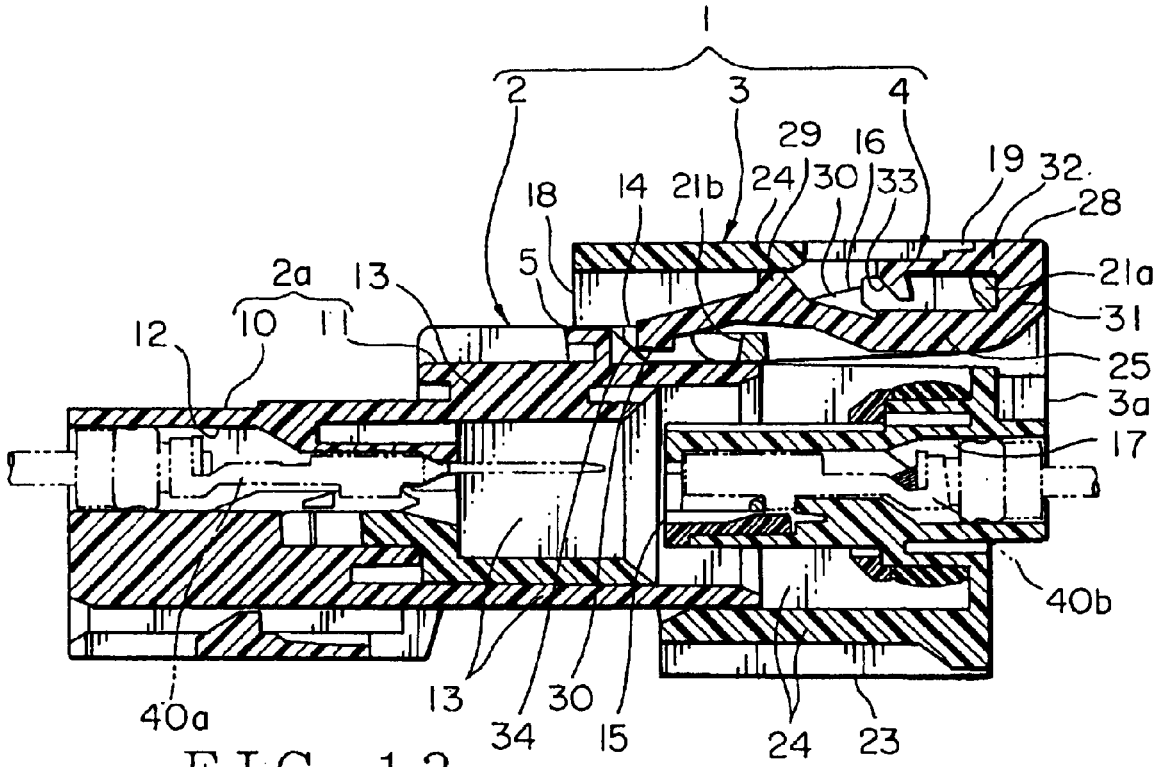
FIG. 13 is a cross sectional view illustrating a state, in which the female and male housings shown in FIG. 1 are started to be fit to each other.

Then, the body part 15 is gradually inserted into the bushing 11 and the female housing 2 is gradually inserted into the bushing 23. Then, as shown in FIG. 13, the tapered surface 14 of the locking projection 5 abuts against the contact surface 34, that is, against the abutting part 30 of the lock security member 4.

Figure 14:
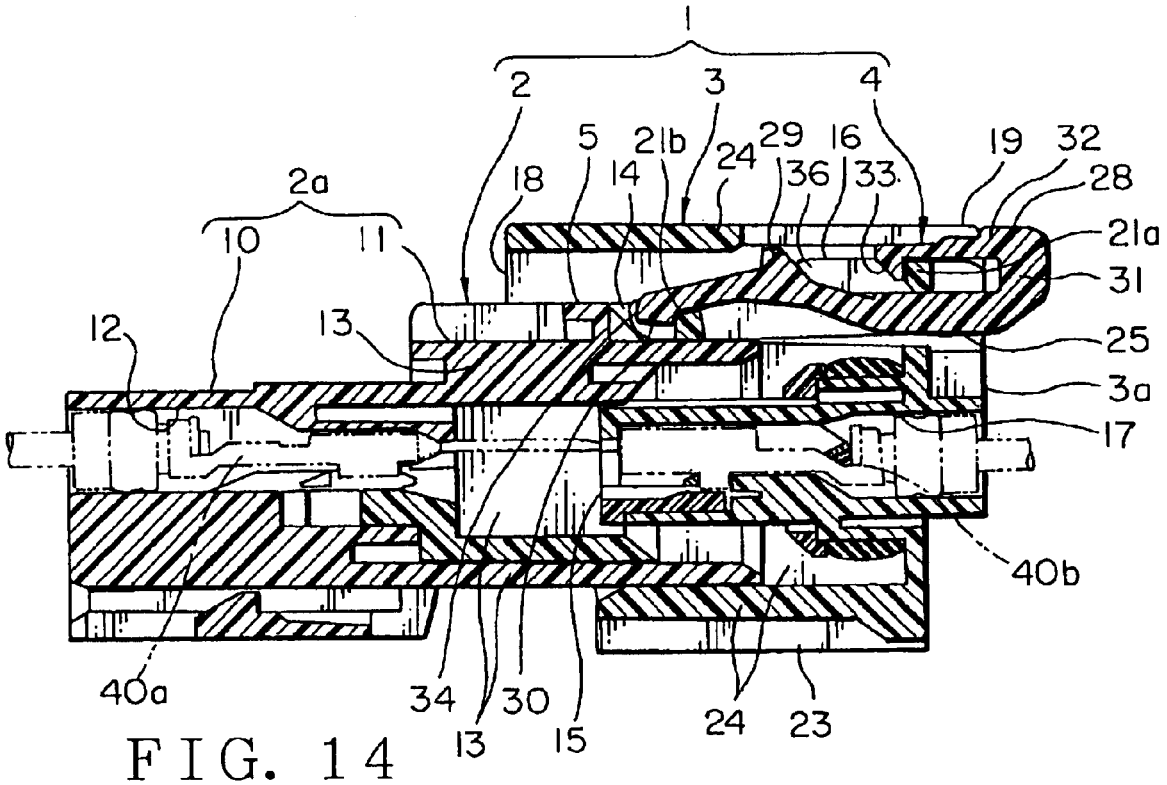
FIG. 14 is a cross sectional view illustrating a state, in which the lock security member is displaced from the state shown in FIG. 13 to a allowed position.

When the body part 15 is further inserted into the bushing 11 and the female housing 2 is further inserted into the bushing 23, the lock security member 4 slides toward the allowed position since the projection 29 faces the inner surface of the peripheral wall 24. Then, the locking arm 16 is once resiliently deformed in the direction, in which the distance between the first bars 20*a* and 20*b* increases, and the claw 26 climbs over the convex 35 and then, as shown in FIG. 14, the lock security member 4 is displaced to the allowed position. Then, the projection 29 is exposed outside through the hole 19. The locking arm 16 becomes resiliently deformable.

Figure 15:
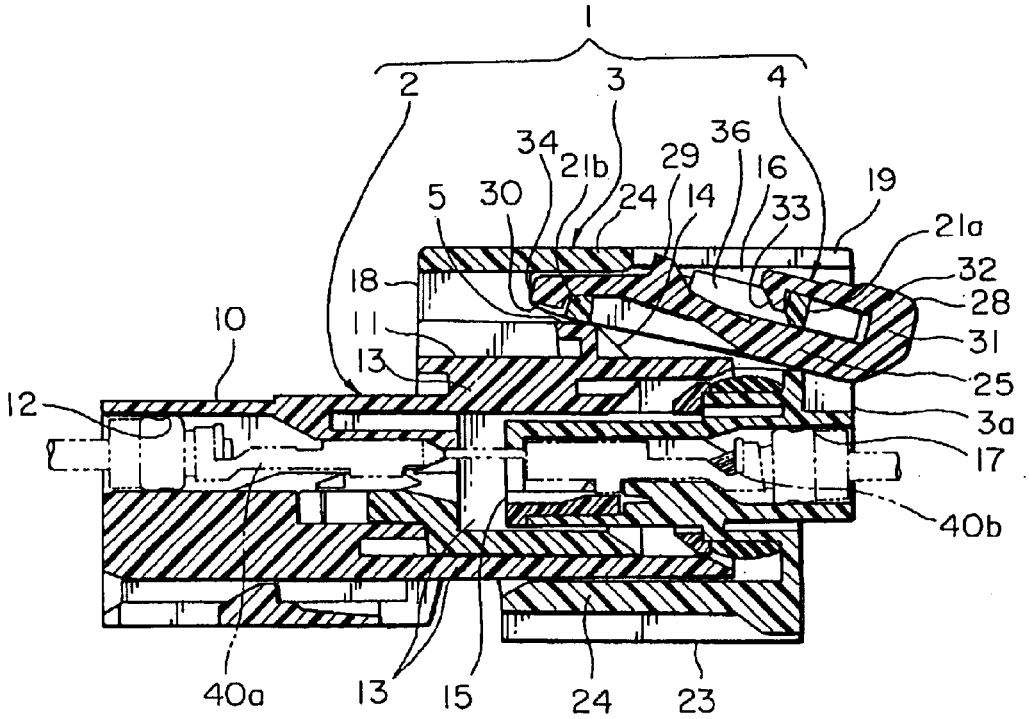
FIG. 15 is a cross sectional view illustrating a state, in which the lock security member and locking arm are resiliently deformed from the state shown in FIG. 14.

When the body part 15 is furthermore inserted into the bushing 11 and the female housing 2 is furthermore inserted into the bushing 23, the abutting part 30 and the second bar 21*b* near to the opening 18 are guided by the tapered surface 14 so as to be displaced to the outside of the male housing 3. At this time, as for the member body 25 of the lock security member 4 and the locking arm 16, the abutting part 30, that is, the opposite end of the member body 25 near to the opening 18 and the second bar 21*b* are resiliently deformed in the direction of approaching the peripheral wall 24. Then, as shown in FIG. 15, the abutting part 30 and the second bar 21*b* climb on the locking projection 5.

Thus, when the female housing 2 is coupled with the male housing 3, the lock security member 4 shifts in the direction of leaving the female housing 2 from the regulated position toward the allowed position until the locking arm 16 engages with the locking projection 5. Further, upon the coupling of the female housing 2 and male housing 3, when the lock security member 4 is situated at the allowed position, the mount 28 protrudes from the outer surface 3*a* of the male housing 3.

When the body part 15 is furthermore inserted into the bushing 11 and the female housing 2 is furthermore inserted into the bushing 23, the abutting part 30 and the second bar 21*b* climbs over the locking projection 5 and the locking projection 5 enters into the locking hole 36. When the locking projection 5 enters into the locking hole 36, as shown in FIG. 16, the locking projection 5 engages with the locking hole 36 by the resilient restoring force of the locking arm 16 and the member body 25.

Thus, when the female housing 2 is coupled with the male housing 3 in a state that the lock security member 4 is situated at the regulated position, the lock security member 4 is displaced to the allowed position. Thereafter, the lock security member 4 is shifted toward the female housing 2. Then, the locking arm 16 is once resiliently deformed in the direction, in which the distance between the first bars 20*a* and 20*b* increases. Then, as shown in FIG. 17, the lock security member 4 is situated at the regulated position. The female housing 2 is coupled with the male housing 3, thereby the male terminal 40*a* is electrically connected to the female terminal 40*b*.

When the coupled female housing 2 and male housing 3 is to be decoupled, first the lock security member 4 is shifted from the regulated position toward the allowed position. Thereafter, the mount 28 is pushed downward in FIG. 16 so as to resiliently deform the locking arm 16 and the lock security member 4, thereby the second bar 21*b* and the abutting part 30 are parted away from the peripheral wall 13 of the female housing 2. Then, the locking projection 5 comes out from the locking hole 36. Then, the female housing 2 is shifted in the direction of leaving the male housing 3, thereby the coupled female housing 2 and male housing 3 is decoupled.

When the female housing 2 is half coupled (i.e., incompletely coupled) with the male housing 2, that is, as shown in FIG. 15, when the abutting part 30 and the second bar 21*b* climb on the locking projection 5 and the locking projection 5 does not engage with the locking hole 36, the lock security member 4 can not shift toward the regulated position since the projection 29 comes in contact with the edge of the hole 19, for example. Thus, by checking whether or not the lock security member 4 can shift toward the regulated position, it can be known whether or not the housings 2 and 3 are securely coupled with each other.

In a state that the housings 2 and 3 are coupled with each other, the projection 29 of the lock security member 4 faces or comes in contact with the inner surface of the peripheral wall 24 of the male housing 3. The projection 29 regulates the deformation of the member body 25 and the locking arm 16 in the direction, in which the engagement between the locking projection 5 and the locking arm 16 is removed. Therefore, in the state that the lock security member 4 is situated at the regulated position and the housings 2 and 3 are coupled with each other, when the coupling between the housings 2 and 3 is tried to be removed, the locking projection 5 keeps engaging with the locking hole 36. Therefore, once the lock security member 4 is situated at the regulated position, the coupled housings 2 and 3 is never accidentally decoupled.

Further, when the lock security member 4 situated at the regulated position is made shift in the direction of leaving the female housing 2 in a state that the housings 2 and 3 are coupled with each other, the projection 29 does not obstruct the movement of the lock security member 4. Therefore, the lock security member 4 can be smoothly shifted to the allowed position. By shifting the lock security member 4 from the regulated position to the allowed position, the coupled housings 2 and 3 can be easily decoupled.

Figure 20:
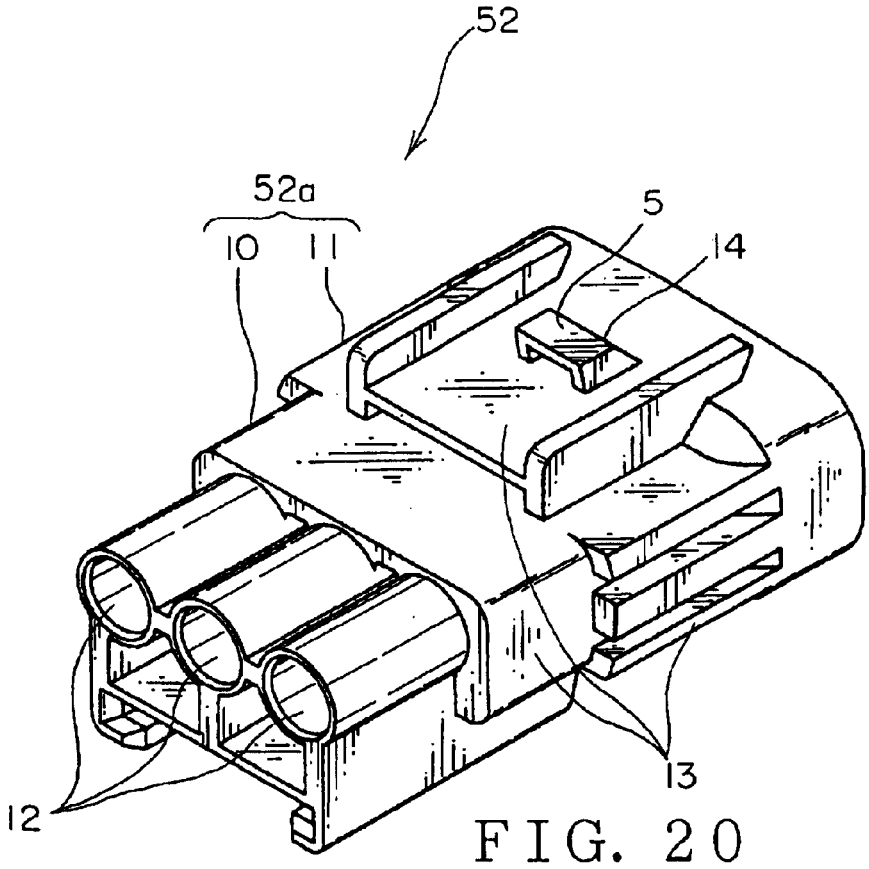
FIG. 20 is a perspective view illustrating a second female housing having a product number different from that of the female housing shown in FIG. 5.

A second female housing 52 as shown in FIG. 20 may be used in a wiring harness in a motor vehicle. As shown in FIGS. 21–24, the second female housing 52 includes a housing body 52*a* and a rib 53 as a projection. Here, the female housing 52 has a product number, which is different from that of the female housing 2.

The housing body 52*a* has the same shape as that of the housing body 2*a* of the female housing 2. In the following, the same reference numerals will be used for the same constitutional elements between the housing bodies 52*a* and 2*a*.

Figure 21:
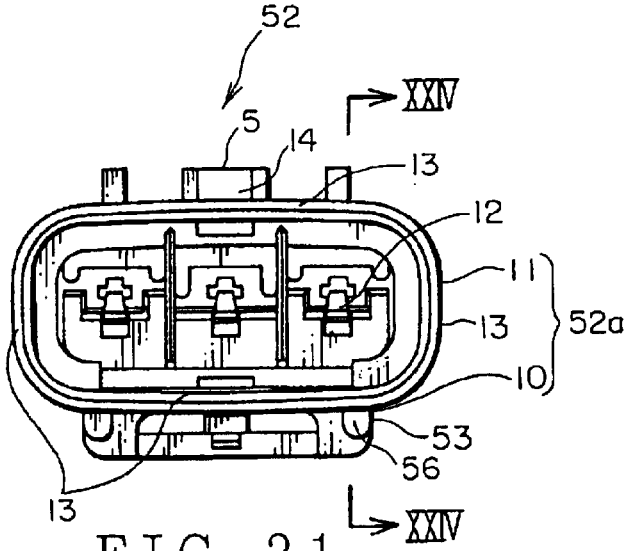
FIG. 21 is a front view illustrating the second female housing shown in FIG. 20.

A rib 53 protrudes toward the outside of the bushing 11 from the peripheral wall situated lower in FIG. 21 among a plurality of peripheral walls 113, which constitute the bushing 11 of the housing body 52*a*. Therefore, the rib 53 protrudes outward from the housing body 52*a*. The rib 53 extends along the direction, in which the second female housing 52 is to be inserted into the bushing 23 of the male housing 3.

Figure 22:
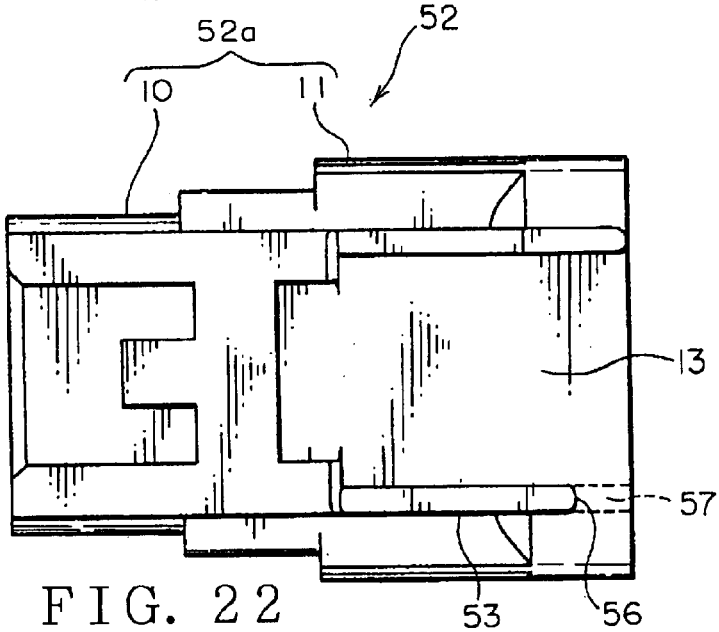
FIG. 22 is a bottom view illustrating the second female housing shown in FIG. 20.
Figure 23:
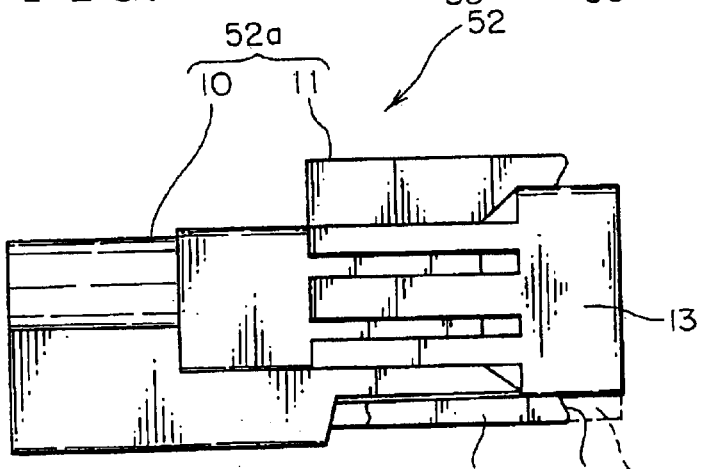
FIG. 23 is a side view illustrating the second female housing shown in FIG. 20.
Figure 24:
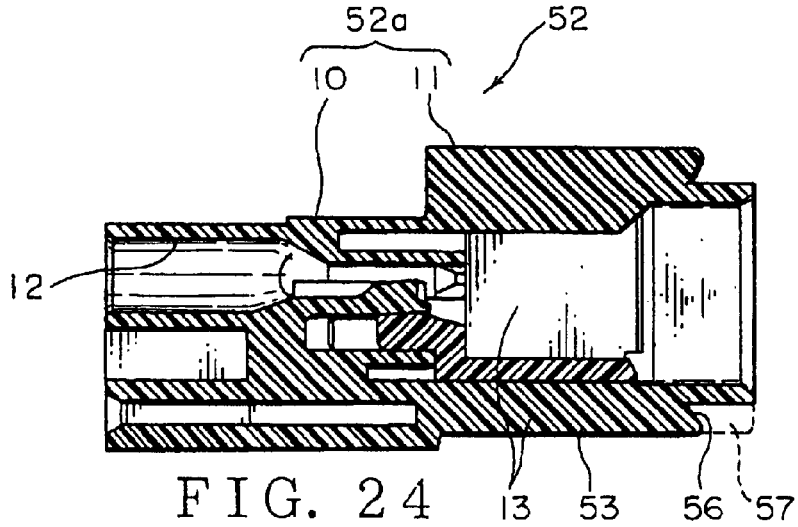
FIG. 24 is a cross sectional view taken along XXIV—XXIV line in FIG. 21.

The rib 53 is provided with a notch 57 (shown by dotted lines in FIGS. 22–24). The notch 57 is formed by notching the edge of the rib 53 near to the male housing 3. The rib 53 is provided at a position where is farther away from the male housing 3 than the edge of the housing body 52*a* near to the male housing 3.

When the second female housing 52 is about to be inserted into the bushing 23 of the male housing 3, as shown in FIGS. 23 and 24, the end surface 56 of the rib 53 facing the male housing 3 is gradually inclined in the direction of approaching the bushing, that is, approaching the housing body 52*a* as leaving the male housing 3. The end surface 56 of the rib 53 is a surface of the notch 57, which faces the male housing 3. The end surface 56 is inclined relatively to the direction, in which the second female housing 52 is about to be inserted into the bushing 23 of the male housing 3.

Figure 25:
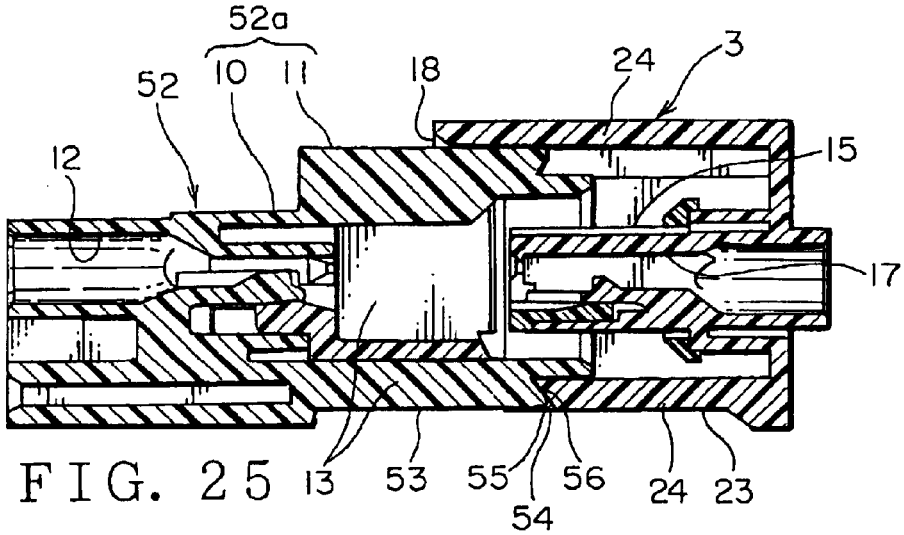
FIG. 25 is a cross sectional view illustrating a state, in which the second female housing shown in FIG. 20 is inserted into the male housing shown in FIG. 2.

When the second female housing 52 is about to be coupled with the male housing 3, first the opening of the bushing 11 is made face the opening 18 of the bushing 23. Then, as shown in FIG. 25, the body part 15 is inserted into the bushing 11 and the second female housing 52 is inserted into the bushing 23. Then, the face 55 of the notch 54 comes in contact with the end surface 56 of the rib 53. Consequently, a second female housing 52 having a product number, which is different from the desired product number of a female housing 2, can not be inserted into the male housing 3.

Figure 26:
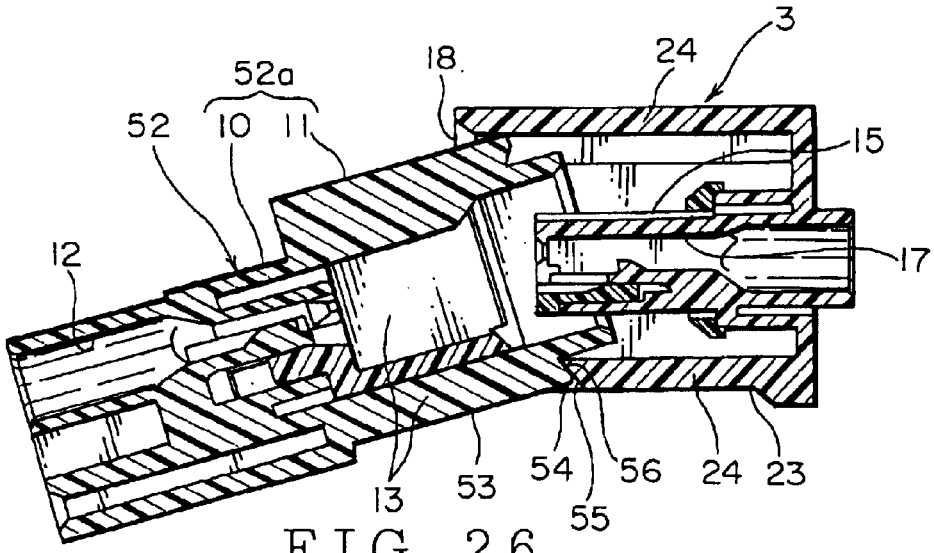
FIG. 26 is a cross sectional view illustrating a state, in which the second female housing shown in FIG. 20 is inserted into the male housing shown in FIG. 2 with being inclined.

As shown in FIG. 26, even when the second female housing 52 is tried to be inserted into the male housing 3 with the second female housing 52 being inclined relatively to the male housing 3, since the face 55 and the end surface 56 are inclined as described above, the rib 53 tends to be displaced toward the outside of the male housing 3 even if the second female housing 52 is made approach the male housing 3. Thereby, the rib 53 is prevented from entering into the bushing 23.

In this preferred embodiment, the obstruction means for preventing the second female housing 52 from entering into the bushing 23 of the male housing 3 is the notch 54 formed by notching the edge of the bushing 23. Therefore, when the second female housing 52 is inserted into the bushing 23 of the male housing 3, the end surface 56 of the rib 53 comes in contact with the face 55 of the notch 54.

The thickness of the bushing 23 becomes thick at a point where the rib 53 comes in contact with. Therefore, even when the second female housing 52 is inserted into the bushing 23 from the inclined direction, the bushing 23 is hard to be resiliently deformed in the direction of the opening 18 of the bushing 23 extending. Further, the face 55 of the notch 54 facing the second female housing 52 is gradually inclined toward the outside of the bushing 23 as the face 55 leaving the second female housing 52. Therefore, even if the rib 53 of the second female housing 52 comes in contact with the face 55 of the notch 54 so as to push the second female housing 52 toward the inside of the bushing 23, the rib 53 tends to be displaced toward the outside of the bushing 23.

Therefore, even if the second female housing 52 is inserted into the bushing 23 from the inclined direction, the rib 53 comes in contact with the notch 54, thereby the second female housing 52 can not be inserted into the bushing 23. That is, the second female housing 52 can not be inserted into the male housing 3, thereby the miscoupling between the male housing 3 and the second female housing 52 can be securely prevented from occurring. That is, the miscoupling between the connector housings 3 and 52 having improper product number can be securely prevented from occurring.

The connector 1 having the lock security mechanism described in the first preferred embodiment corresponds to the connector described in the claims. The male housing 3 corresponds to the connector housing described in the claims. The female housing 2 corresponds to the first mating connector housing described in the claims. The second female housing 52 corresponds to the second mating connector housing described in the claims. The bushing 23 corresponds to the casing described in the claims. The housing body 2*a* corresponds to the first housing body described in the claims. The housing body 52*a* corresponds to the second housing body described in the claims. The rib 53 corresponds to the projection described in the claims. The notch 54 corresponds to the notch described in the claims. The face 55 corresponds to the face described in the claims.

When the female housing 2 is about to be coupled with the male housing 3, the lock security member 4 is displaced from the regulated position to the allowed position. Therefore, a worker can easily recognize the lock security member 4. That is, a worker does not forget to displace the lock security member 4 toward the regulated position. Therefore, after the coupling of the housings, an accidental decoupling between the female housing 2 and male housing 3 can be securely prevented from occurring.

Further, by checking the position of the lock security member 4, it can be securely known whether or not the locking arm 16 engages with the locking projection 5. Therefore, after the coupling of the housings, an accidental decoupling between the female housing 2 and male housing 3 can be securely prevented from occurring.

Further, when the female housing 2 is about to be coupled with the male housing 3, the mount 28 of the lock security member 4 protrudes from the outer surface 3*a* of the male housing 3 toward the outside. Therefore, a worker can easily recognize the lock security member 4. That is, a worker does not forget to displace the lock security member 4 toward the regulated position. Therefore, after the coupling of the housings, an accidental decoupling between the female housing 2 and male housing 3 can be securely prevented from occurring.

At the allowed position, the mount 28 of the lock security member 4 protrudes. Therefore, the locking arm 16 can be easily deformed resiliently through the lock security member 4 and the engagement between the locking arm 16 and the locking projection 5 can be easily removed. That is, the coupling between the female housing 2 and the male housing 3 can be easily removed.

The pair of claws 26 and pair of convexes 35 maintain the position of the lock security member 4. Therefore, after the coupling between the female housing 2 and the male housing 3, the lock security member 4 displaced to the regulated position can be prevented from being displaced to the allowed position. Therefore, after the coupling of the housings, an accidental decoupling between the female housing 2 and male housing 3 can be securely prevented from occurring.

At the regulated position, the projection 29 comes in contact with the inner surface of the peripheral wall 24 of the male housing 3, thereby preventing the member body 25 of the lock security member 4 and the locking arm 16 from being resiliently deformed. That is, at the regulated position, the projection 29 regulates the resilient deformation of the locking arm 16. Thus, when the lock security member 4 is situated at the regulated position, the resilient deformation of the locking arm 16 is regulated, thereby preventing an accidental decoupling of the housings 2 and 3.

In a state that the locking arm 16 is resiliently deformed, the projection 29 tends to protrude from the hole 19. Therefore, in a state that the locking arm 16 is resiliently deformed, the projection 29 keeps the lock security member 4 at the allowed position. Thus, a worker can easily know whether or not the locking arm 16 completely engages with the locking projection 5, that is, whether or not the female housing 2 is completely coupled with the male housing 3.

Figure 27:
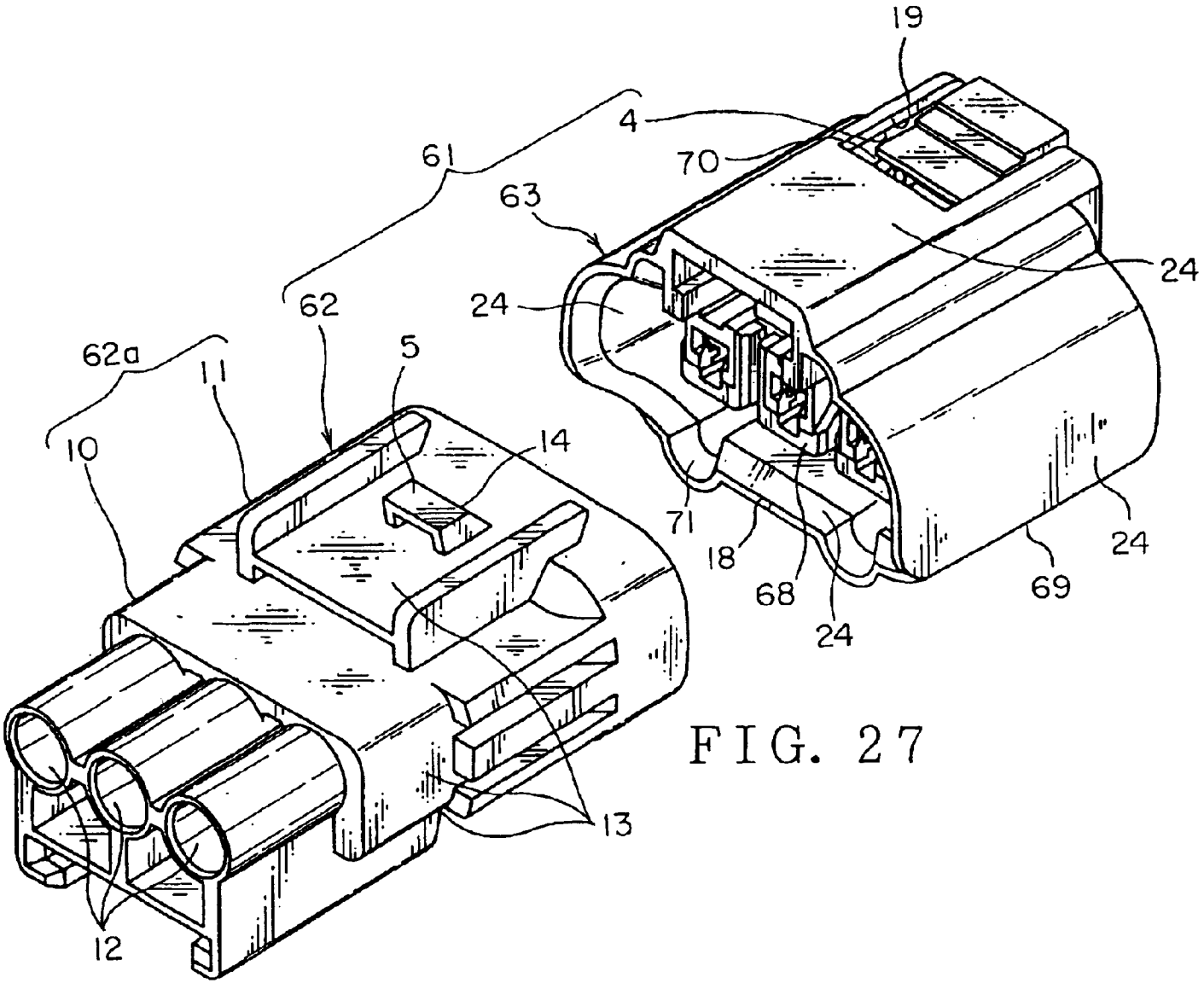
FIG. 27 is an exploded perspective view illustrating a connector having a lock security mechanism according to a second preferred embodiment of the present invention.

A connector having a lock security mechanism as a connector according to a second preferred embodiment of the present invention will be explained with reference to FIGS. 27–40. As shown in FIG. 27, the connector 61 having a lock security mechanism includes a third female housing 62, a second male housing 63, and a lock security member 4.

As shown in FIGS. 31–34, the third female housing 62 includes a housing body 62*a* and a rib 64 as a second projection. The housing body 62*a* has the same constitution as that of the housing body 52*a* of the second female housing 52 or that of the housing body 2*a* of the female housing 2. Therefore, the same reference numerals will be used in the following explanation.

The rib 64 is provided with a second notch 67 (shown by dotted lines in FIGS. 32–34) as the second obstruction means. The second notch 67, which acts when the third female housing 62 is about to be inserted into the second or third male housing 63 or 73, is formed by notching the edge of the rib 64 near to the second or third male housing 63 or 73. The rib 64 is provided at a position staying away from the second or third male housing 63 or 73 farther than the edge of the housing body 62*a* near to the second or third male housing 63 or 73.

Figure 33:
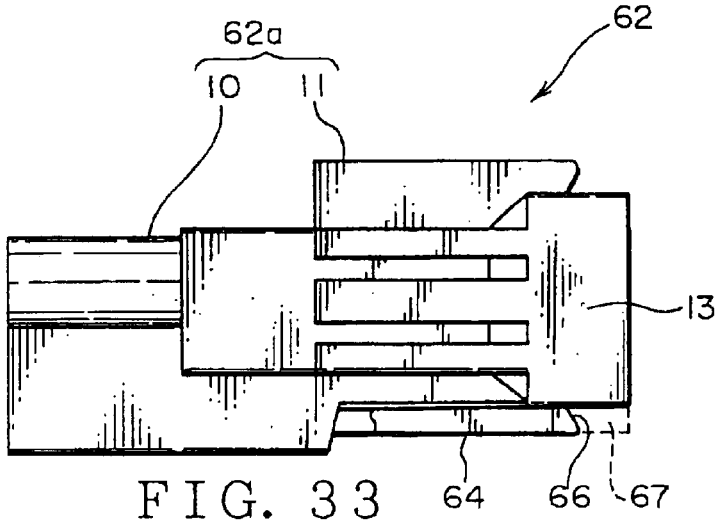
FIG. 33 is a side view illustrating the third female housing shown in FIG. 31.
Figure 34:
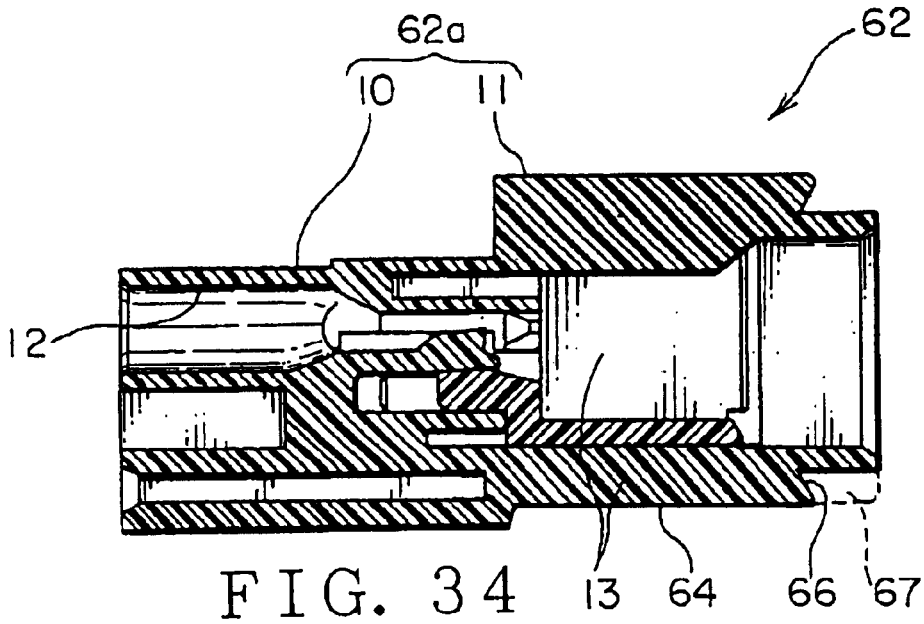
FIG. 34 is a cross sectional view taken along XXXIV—XXXIV line in FIG. 31.
Figure 35:
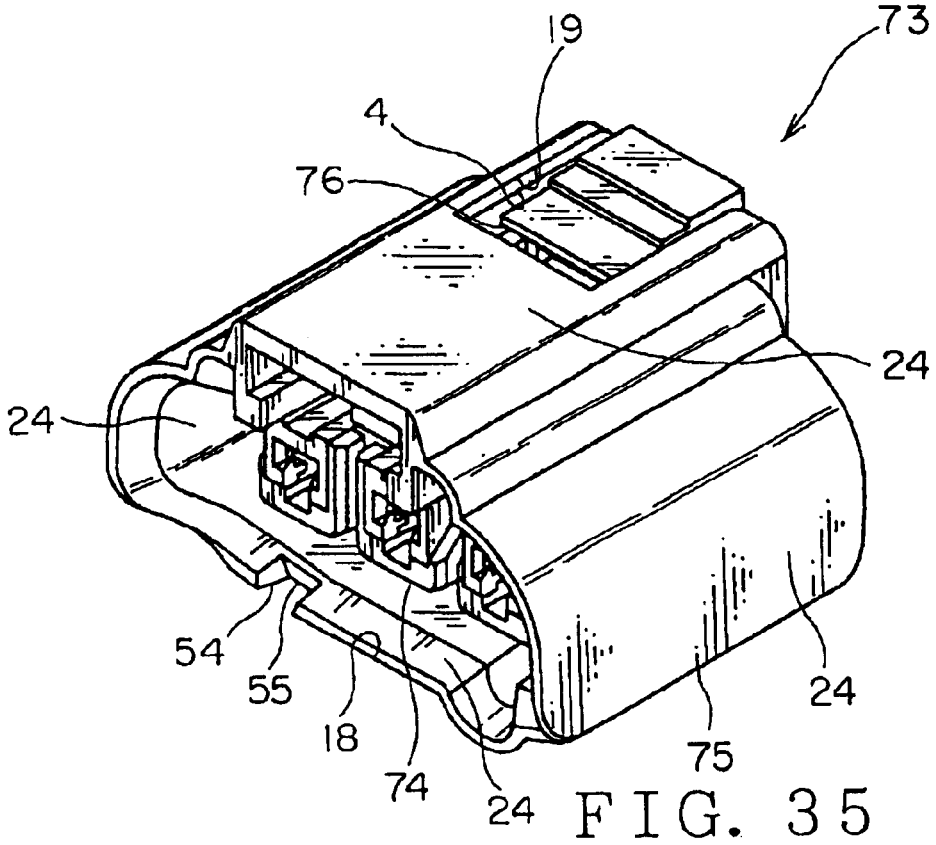
FIG. 35 is a perspective view illustrating a third male housing having a product number different from that of the second male housing shown in FIG. 28.
Figure 36:
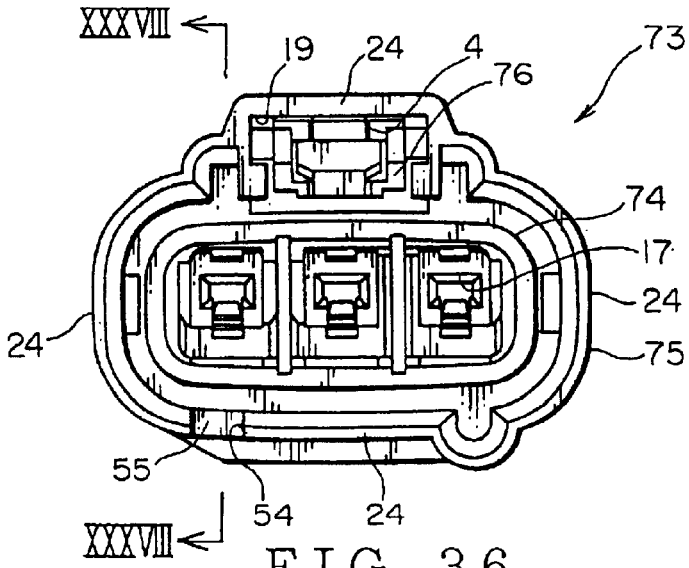
FIG. 36 is a front view illustrating the third male housing shown in FIG. 35.
Figure 37:
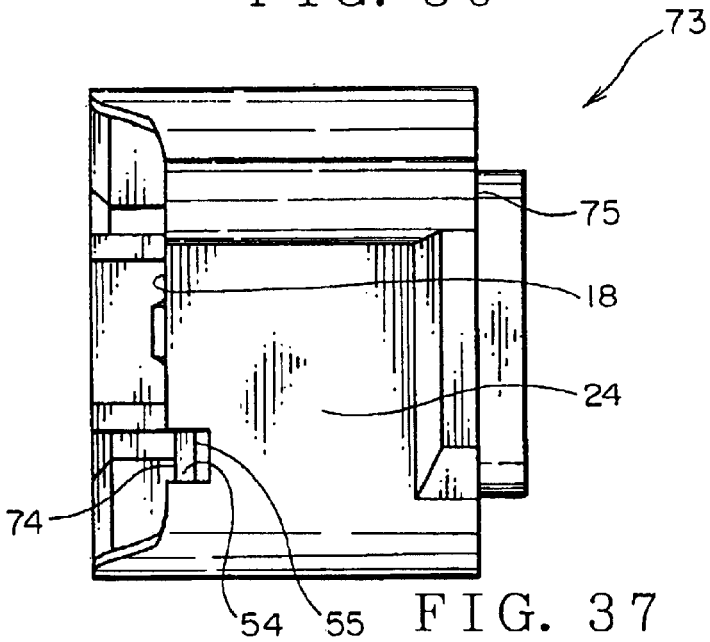
FIG. 37 is a bottom view illustrating the third male housing shown in FIG. 35.
Figure 38:
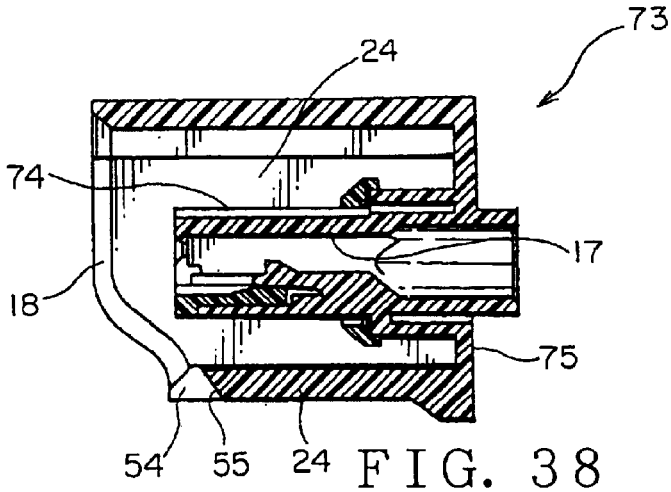
FIG. 38 is a cross sectional view taken along XXXVIII—XXXVIII line in FIG. 36.

When the third female housing 62 is about to be inserted into the bushing 69 or 75 of the second or third male housing 63 or 73, as shown in FIGS. 33 and 34, an end face 66 of the rib 64 facing the second or third male housing 63 or 73 is inclined in the direction of approaching the bushing 11, that is, approaching the housing body 62*a* as the end face 66 leaving the second or third male housing 63 or 73. The end face 66 is a surface of the second notch 67, which faces the second or third male housing 63 or 73. The end face 66 is inclined relatively to the direction, in which the third female housing 62 is inserted into the busing 69 or 75 of the second or third male housing 63 or 73.

Figure 28:
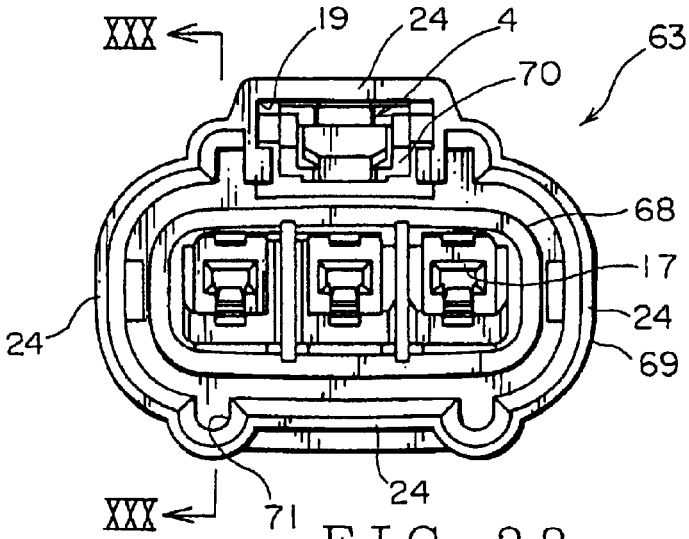
FIG. 28 is a front view of a second male housing of the connector having a lock security mechanism shown in FIG. 27.
Figure 29:
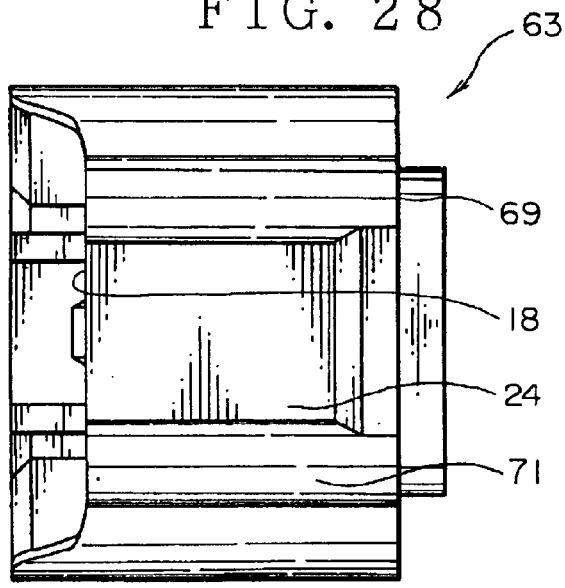
FIG. 29 is a bottom view of the second male housing shown in FIG. 28.
Figure 30:
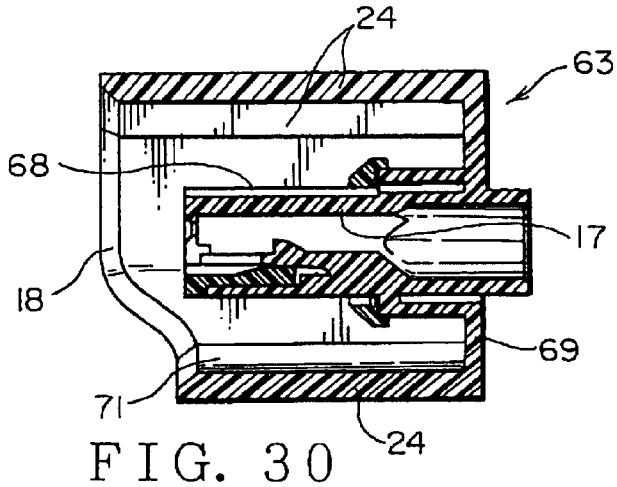
FIG. 30 is a cross sectional view taken along XXX—XXX line in FIG. 28.
Figure 31:
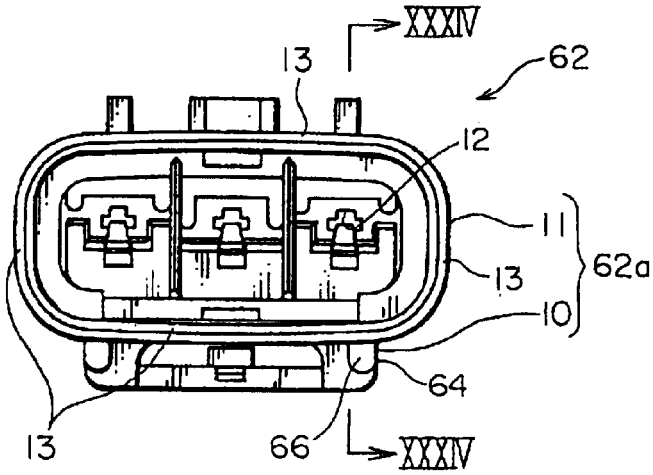
FIG. 31 is a front view of a third female housing of the connector having a lock security mechanism shown in FIG. 27.
Figure 32:
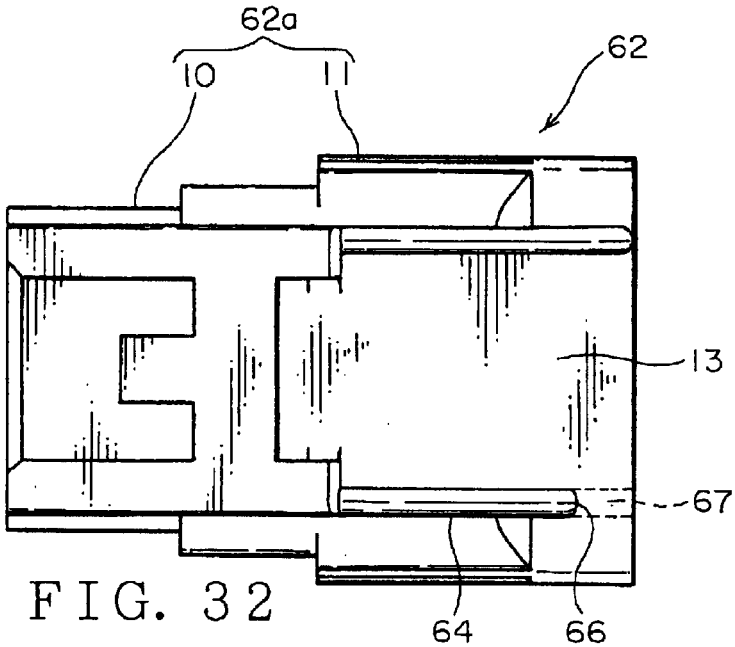
FIG. 32 is a bottom view illustrating the third female housing shown in FIG. 31.

As shown in FIGS. 28–30, the second male housing 63 includes a body part 68, bushing 69, locking arm 70 and recess 71. The body part 68 has the same constitution as that of the body part 15 of the male housing 3 described above, therefore the same reference numerals will be used in the following explanation. The bushing 69 has the same constitution as that of the bushing 23 of the male housing 3 described above, therefore the same reference numerals will be used in the following explanation. The locking arm 70 has the same constitution as that of the locking arm 16 of the male housing 3 described above, therefore the same reference numerals will be used in the following explanation.

The recess 71 is provided at a position where the recess 71 faces the rib 64 when the third female housing 62 is inserted into the bushing 69 of the second male housing 63. The recess 71 is formed hollow from the inner surface of the peripheral wall 24 and formed protrusive from the outer surface of the peripheral wall 24. The recess 71 is formed in an arc-shape in its cross sectional view. The recess 71 extends in the direction, in which the third female housing 62 is inserted into the bushing 69 of the second male housing 63. The rib 64 enters into the recess 71 when the third female housing 62 is inserted into the bushing 69 of the second male housing 63.

In a connector 61 having a lock security mechanism, similarly to the first preferred embodiment described above, when the third female housing 62 is coupled with the second male housing 63, the body part 68 is inserted into the busing 11 of the third female housing 62 and the third female housing 62 is inserted into the bushing 69 of the second male housing 63.

A third male housing 73 as shown in FIGS. 35–38 may be used in a wiring harness in a motor vehicle. The third male housing 73 has a product number, which is different from that of the second male housing 63.

As shown in FIGS. 35–38, the third male housing 73 includes a body part 74, bushing 75 and locking arm 76. The body part 74 has the same constitution as that of the body part 15 of the male housing 3, therefore the same reference numerals will be used in the following explanation. The bushing 75 has the same constitution as that of the bushing 23 of the male housing 3, therefore the same reference numerals will be used in the following explanation. The locking arm 76 has the same constitution as that of the locking arm 16 of the male housing 3, therefore the same reference numerals will be used in the following explanation. The third male housing 73 does not include a recess 71 facing the rib 64. The third male housing 73 is provided with a notch 54 facing the rib 64.

Figure 39:
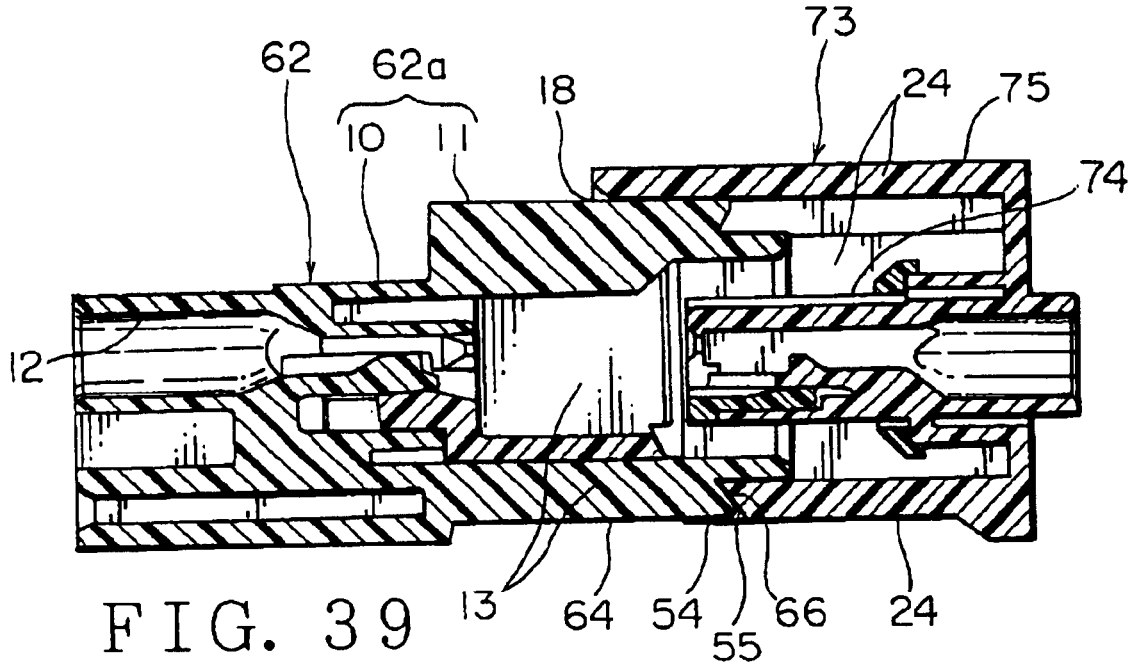
FIG. 39 is a cross sectional view illustrating a state, in which the third female housing shown in FIG. 31 is inserted into the third male housing shown in FIG. 35.

When the third female housing 62 is about to be coupled with the third male housing 73, as shown in FIG. 39, the body part 74 is inserted into the bushing 11 and the third female housing 62 is inserted into the bushing 75. Then, the end face 66 of the rib 64 comes in contact with the face 55 of the notch 54. Therefore, the third female housing 62 can not be inserted into the third male housing 73 having a product number different from that of the desired second male housing 63.

Figure 40:
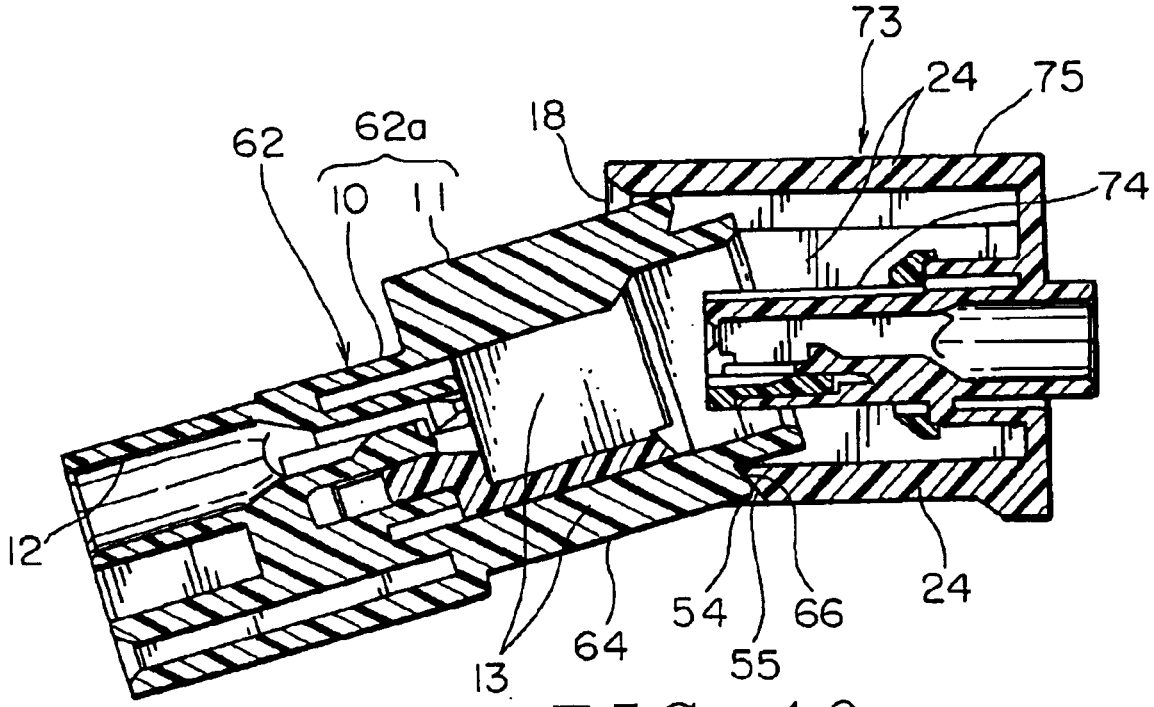
FIG. 40 is a cross sectional view illustrating a state, in which the third female housing shown in FIG. 31 is inserted into the third male housing shown in FIG. 35 with being inclined.

As shown in FIG. 40, even when the third female housing 62 is tried to be inserted into the third male housing 73 with the third female housing 62 being inclined relatively to the third male housing 73, since the rib 64 is provided with the second notch 67 and the end surface 66 is inclined as described above, the rib 64 tends to be displaced toward the outside of the third male housing 73 even if the third female housing 62 is made approach the third male housing 73. Thereby, the rib 64 is prevented from entering into the third male housing 73.

In this preferred embodiment, the second notch 67 is formed by notching the edge of the rib 64 near to the second or third male housing 63 or 73. Therefore, the rib 64 is situated at a position staying away from the second or third male housing 63 or 73 farther than the edge of the housing body 62*a* near to the second or third male housing 63 or 73. When the third female housing 62 is inserted into the bushing 75 of the third male housing 73, the rib 64 comes in contact with the notch 54, that is, the edge of the bushing 75.

Further, the end surface 66 of the rib 64 is inclined relatively to the direction of approaching the housing body 62*a* as the end surface 66 leaving the third male housing 73. Since the end surface 66 comes in contact with the face 55 of the notch 54, therefore the rib 64 tends to be displaced toward the outside of the bushing 75 even if the third female housing 62 is pushed toward the inside of the bushing 75.

Therefore, even if the third female housing 62 is inserted into the bushing 75 from the inclined direction, the rib 64 does not enter into the bushing 75. That is, the third female housing 62 can not be inserted into the third male housing 73, thereby the miscoupling between the third male housing 73 and the third female housing 62 can be securely prevented from occurring. That is, the miscoupling between the connector housings 62 and 73 having improper product number can be securely prevented from occurring.

The connector 61 having the lock security mechanism described in the second preferred embodiment corresponds to the connector described in the claims. The third female housing 62 corresponds to the second connector housing described in the claims and corresponds to the connector housing described in the claims. The second male housing 63 corresponds to the third mating connector housing described in the claims. The third male housing 73 corresponds to the fourth mating connector housing described in the claims. The housing body 62*a* corresponds to the third housing body described in the claims. The rib 64 corresponds to the second projection described in the claims. The bushing 69 corresponds to the second casing described in the claims. The recess 71 corresponds to the recess described in the claim. The bushing 75 corresponds to the third casing described in the claims. The second notch 67 corresponds to the second notch described in the claims. The end face 66 of the rib 64 corresponds to the face of the second notch described in the claims.

In the first and second preferred embodiments described above, the female housing 2, 52, 62 is provided with the locking projection 5 and the male housing 3, 63, 73 is provided with the lock security member 4, locking arm 16 and the locking hole 36. Instead, the male housing 3, 63, 73 may be provided with the locking projection 5 and the female housing 2, 52, 62 may be provided with the lock security member 4, locking arm 16 and the locking hole 36.

The aforementioned preferred embodiments are described to aid in understanding the present invention and variations may be made by one skilled in the art without departing from the spirit and scope of the present invention.

What is claimed is:

1. A connector housing to be coupled with a first mating connector housing, comprising:

a tube-shaped casing, into which a first housing body of the first mating connector housing can enter; and obstruction means for preventing a second mating connector housing, which includes a second housing body of the same shape as that of the first housing body and notching an edge of the casing near a point of contact a projection outwardly protruding from the second housing body, from entering into the casing, wherein the obstruction means is a notch formed by with the second mating connector housing and the notch faces the projection when the second mating connector housing enters into the casing, wherein a face of the notch facing the second mating connector housing is gradually inclined toward the outside of the casing as the face leaving the second mating connector housing and also is inclined relatively to the insertion direction of the second mating connector housing into the casing.

* * * * *